US011142437B2

(12) United States Patent
Kurihara

(10) Patent No.: US 11,142,437 B2
(45) Date of Patent: Oct. 12, 2021

(54) RISING AND FALLING BODY OF WORK MACHINE AND METHOD FOR STORING RISING AND FALLING BODY OF WORK MACHINE

(71) Applicant: KOBELCO CONSTRUCTION MACHINERY CO., LTD., Hiroshima (JP)

(72) Inventor: Shingo Kurihara, Hyogo (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 88 days.

(21) Appl. No.: 16/637,902

(22) PCT Filed: Aug. 3, 2018

(86) PCT No.: PCT/JP2018/029271
§ 371 (c)(1),
(2) Date: Feb. 10, 2020

(87) PCT Pub. No.: WO2019/035375
PCT Pub. Date: Feb. 21, 2019

(65) Prior Publication Data

US 2020/0165108 A1 May 28, 2020

(30) Foreign Application Priority Data

Aug. 18, 2017 (JP) ..... JP2017-158135

(51) Int. Cl.
*B66C 23/68* (2006.01)

(52) U.S. Cl.
CPC ..... *B66C 23/68* (2013.01)

(58) Field of Classification Search
CPC ..... B66C 23/68; B66C 23/82; B66C 23/42
See application file for complete search history.

(56) References Cited

U.S. PATENT DOCUMENTS 8,863,964 B2 * 10/2014 Terauchi ..... B66C 23/823 212/256
10,099,905 B2 * 10/2018 Kuninaga ..... B66C 23/348
(Continued)

FOREIGN PATENT DOCUMENTS

| | | | |
|---|---|---|---|
| JP | 2-83891 | U | 6/1990 |
| JP | 2014-144853 | A | 8/2014 |
| JP | 2017-7777 | A | 1/2017 |

OTHER PUBLICATIONS

International Search Report dated Oct. 2, 2018 in PCT/JP2018/029271 filed on Aug. 3, 2018, 1 page.
(Continued)

*Primary Examiner* — Michael R Mansen
*Assistant Examiner* — Juan J Campos, Jr.
(74) *Attorney, Agent, or Firm* — Oblon, McClelland, Maier & Neustadt, L.L.P.

(57) ABSTRACT

A first width direction bending portion bendably connects a portion of a guy link on a distal end side with respect to a first link portion to the first link portion in a width direction. When the guy link is in a stored state, the portion of the guy link located on the distal end side with respect to the first width direction bending portion is disposed outside the first link portion in the width direction. When the guy link is in a stored state, at least a portion of the guy link is disposed on the outer side in the width direction than a front strut and on a back surface or a side surface of a lower jib.

10 Claims, 16 Drawing Sheets

(56) References Cited

U.S. PATENT DOCUMENTS

| | | | | |
|---|---|---|---|---|
| 2009/0127219 | A1 | 5/2009 | Willim | |
| 2010/0243595 | A1* | 9/2010 | Walker | B66C 23/82 212/294 |
| 2014/0083964 | A1* | 3/2014 | Kurotsu | B66C 23/68 212/177 |
| 2014/0209552 | A1 | 7/2014 | Otsuka | |
| 2014/0231374 | A1* | 8/2014 | Foust | B66F 19/00 212/347 |
| 2014/0263140 | A1* | 9/2014 | Inada | B66C 23/68 212/177 |
| 2017/0275142 | A1* | 9/2017 | Yoda | B66C 23/26 |
| 2018/0282136 | A1* | 10/2018 | Maedo | B66C 23/82 |
| 2018/0346290 | A1* | 12/2018 | Brueckner | B66C 23/42 |

OTHER PUBLICATIONS

Extended European Search Report dated Jun. 15, 2020 in European Patent Application No. 18845664.4, 6 pages.

* cited by examiner

RISING AND FALLING BODY OF WORK MACHINE AND METHOD FOR STORING RISING AND FALLING BODY OF WORK MACHINE

CROSS-REFERENCE TO RELATED APPLICATIONS

This application is a United States national stage application of International Application No. PCT/JP2018/029271, filed Aug. 3, 2019, which designates the United States, and claims priority to Japan Patent Application No. 2017-158135, filed Aug. 18, 2017, and the entire contents of each of the above applications are hereby incorporated herein by reference in entirety.

TECHNICAL FIELD

The present invention relates to a rising and falling body of a work machine, and a method for storing a rising and falling body of a work machine.

BACKGROUND ART

For example, Patent Document 1 describes a conventional crane as a work machine. As described in FIG. 1 of Patent Document 1 and the like, this crane includes a guy link mounted on a rising and falling member.

CITATION LIST

Patent Literature

Patent Literature 1: JP 2017-7777 A

SUMMARY OF INVENTION

There may be a case where the rising and falling body, which includes two rising and falling members and a guy link, is transported integrally. In such transportation, the other rising and falling member (second rising and falling member) is placed on one rising and falling member (first rising and falling member). In this case, there arises a problem where the guy link is to be disposed (stored). When the guy link is disposed between the first rising and falling member and the second rising and falling member in the vertical direction, a space for disposing the guy link is necessary between the first rising and falling member and the second rising and falling member. In this case, there is a concern that a size of the first rising and falling member and the second rising and falling member in the vertical direction is increased (become large). On the other hand, in a case where the rising and falling members and the guy link are respectively transported in a state where the guy link is removed from the rising and falling members, it takes time and effort to attach or detach the guy link to or from the rising and falling members.

Therefore, it is an object of the present invention to provide a rising and falling body of a work machine and a method for storing a rising and falling body of a work machine in which a height of the rising and falling body during transportation can be suppressed, and time and effort for attaching and detaching a guy line to and from the rising and falling member can be suppressed.

Means for Solving the Problem

A rising and falling body of a work machine according to an aspect of the present invention is a rising and falling body of a work machine that is mounted on a machine body of a work machine and is capable of changing a state between a working state where the rising and falling body performs predetermined work and a stored state where the rising and falling body is removed from the machine body and is transportable, the rising and falling body including: a first rising and falling member mounted on the work machine so as to be raised or lowered about a horizontal first rotation axis, the first rising and falling member having a predetermined width along a first width direction parallel to the first rotation axis in a state where the first rising and falling member is mounted on the work machine, the first rising and falling member extending along a first longitudinal direction orthogonal to the first width direction; a second rising and falling member having a proximal end portion mounted on the work machine so as to be raised or lowered about a horizontal second rotation axis and a distal end portion opposite to the proximal end portion, the second rising and falling member having a predetermined width along a second width direction parallel to the second rotation axis in a state of being mounted on the work machine, the second rising and falling member extending along a second longitudinal direction orthogonal to the second width direction; and a guy link mounted on the distal end portion of the second rising and falling member so as to be swingable relative to the second rising and falling member, wherein in the working state, the first rising and falling member and the second rising and falling member are mounted on the work machine and the guy link is connected to the distal end portion of the second rising and falling member, and in the stored state, the first rising and falling member is laid down and the second rising and falling member is placed on the first rising and falling member so as to extend along the first rising and falling member, and the guy link is supported by the distal end portion of the second rising and falling member and at least a portion of the guy link is supported by the first rising and falling member, a width in the second width direction of a portion of the second rising and falling member that is closer to the proximal end portion than to the distal end portion is set to be larger than a width in the second width direction of the distal end portion of the second rising and falling member, and the guy link includes: a first link portion mounted on the distal end portion of the second rising and falling member so as to be swingable about a center axis extending in parallel with the second width direction; a second link portion disposed at a position farther from the center axis than the first link portion is; and a first bending portion that connects the first link portion and the second link portion so that the second link portion is bendable in the second width direction with respect to the first link portion, wherein the first bending portion allows the guy link to be bent at the first bending portion such that the second link portion is disposed outside in the second width direction than the first link portion in the stored state, thus allowing at least a portion of the guy link located opposite to the first link portion as viewed from the first bending portion to be fixed to at least one of an upper surface of the first rising and falling member and a side surface of the first rising and falling member outside the second rising and falling member in the second width direction.

Further, a method for storing a rising and falling body of a work machine according to another aspect of the present invention is a method for storing a rising and falling body of a work machine, the rising and falling body including: a first rising and falling member mounted on the work machine so as to be raised or lowered about a horizontal rotation axis; a second rising and falling member having a proximal end portion mounted on the work machine so as to be raised or lowered about a horizontal rotation axis and a distal end portion opposite to the proximal end portion; and a guy link mounted on the distal end portion of the second rising and falling member so as to be swingable relative to the second rising and falling member. The method for storing a rising and falling body of a work machine includes: a preparation step of preparing, as the guy link, a structure including: a first link portion mounted on the distal end portion of the second rising and falling member so as to be swingable about a center axis extending in a width direction parallel to the rotation axis of the second rising and falling member; a second link portion disposed at a position farther from the center axis than the first link portion is; and a first bending portion that connects the first link portion and the second link portion so that the second link portion is bendable in the width direction with respect to the first link portion; a guy link suspending step of bringing about a state where the first rising and falling member is laid down, the second rising and falling member is disposed above the first rising and falling member such that the distal end portion of the second rising and falling member is disposed at a position higher than the proximal end portion of the second rising and falling member, and the guy link is suspended from the distal end portion of the second rising and falling member; a first bending step of, after the guy link suspending step, lowering the distal end portion of the second rising and falling member, and bending the guy link at the first bending portion such that the second link portion of the guy link is disposed on an outer side in the width direction with respect to the first link portion; and a guy link storing step of, after the first bending step, supporting at least a portion of the guy link located opposite to the first link portion as viewed from the first bending portion on at least one of an upper surface and a side surface of the first rising and falling member on an outer side in the width direction of the second rising and falling member.

DESCRIPTION OF EMBODIMENTS

A crane 1 which includes a rising and falling body 1S according to an embodiment of the present invention will be described with reference to FIGS. 1 to 16.

Figure 1:
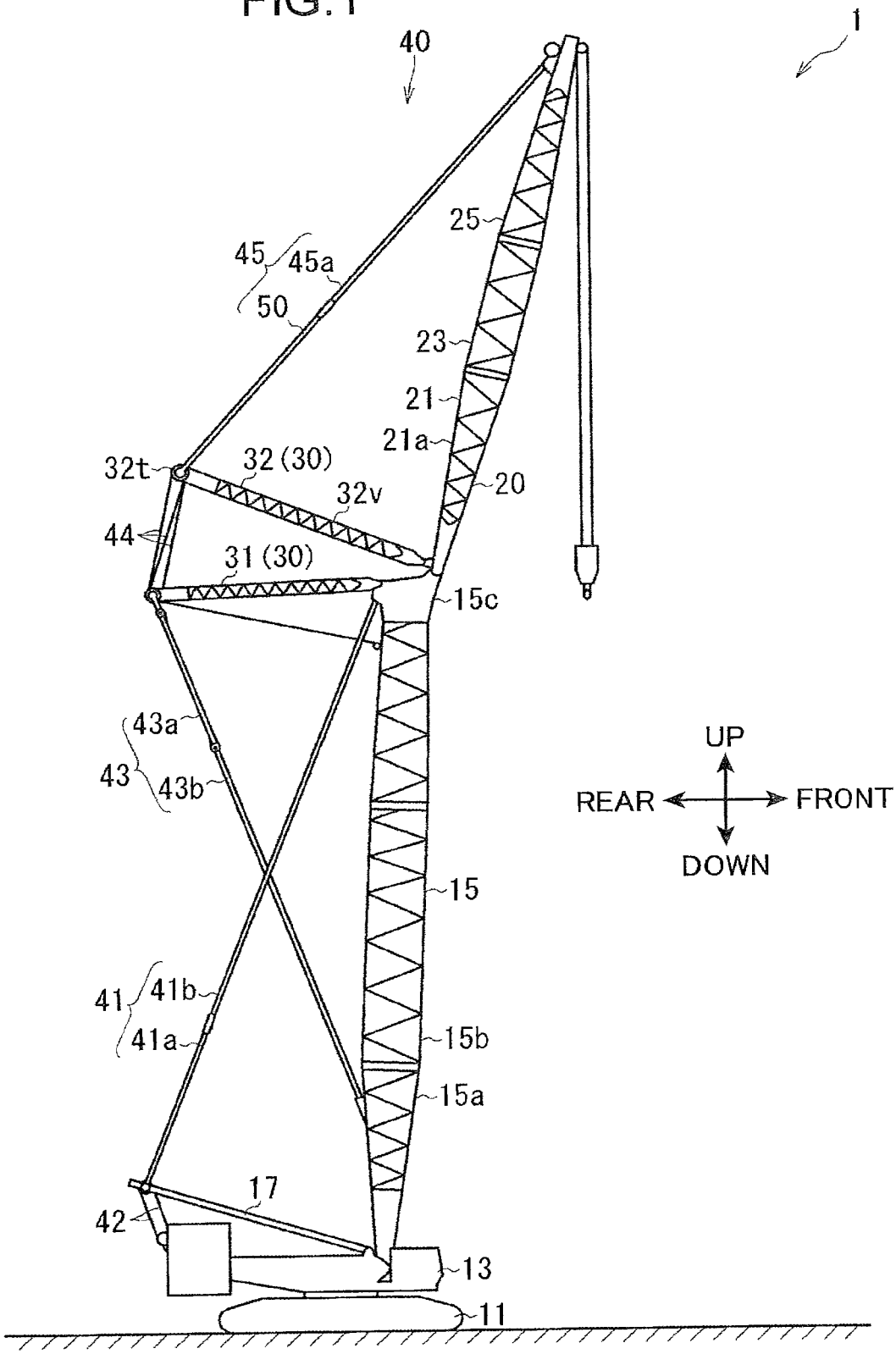
FIG. 1 is a side view of a work machine according to an embodiment of the present invention as viewed in a lateral direction.

As shown in FIG. 1 the crane 1 is a machine having rising and falling members (such as a boom 15). The crane 1 is a construction machine that performs work such as construction work. The crane 1 is a mobile crane, for example. However, the crane 1 may be a fixed crane, for example. The crane 1 includes a lower travelling body 11, an upper slewing body 13 (machine body), a boom 15 (rising and falling member), a mast 17 (rising and falling member), a jib 20 (rising and falling member), a strut 30 (rising and falling member), a connecting member 40, a receiving jig 70 (see FIG. 7), and a tightly fastening member 90 (see FIG. 7).

The lower travelling body 11 is a portion that allows the crane 1 to travel. The lower travelling body 11 includes, for example, crawlers, and may include, for example, wheels. The upper slewing body 13 can turn relative to the lower travelling body 11, and is disposed above the lower travelling body 11. A horizontal direction orthogonal to a longitudinal direction of the upper slewing body 13 is assumed as the width direction (the width direction or the lateral direction of the rising and falling member). The width direction means the width direction of the boom 15, the width direction of the mast 17, the width direction of the jib 20, and the width direction of the strut 30. A perpendicular direction is also called a vertical direction. The vertical direction includes an upward direction and a downward direction.

The boom 15 is mounted on the upper slewing body 13 so as to be raised and lowered. The boom 15 is rotatable with respect to the upper slewing body 13 about a rotation axis extending along the width direction. The boom 15 has a lattice structure (a lattice boom). The boom 15 may have a box structure. The boom 15 includes a plurality of parts (parts forming the boom 15). The parts forming the boom 15 include a lower boom 15*a*, an intermediate boom 15*b*, and an upper boom 15*c*. The lower boom 15*a* is mounted on the upper slewing body 13, and is disposed on the most proximal end side (upper slewing body 13 side) of the boom 15 among the parts forming the boom 15. The intermediate boom 15*b* is disposed between the lower boom 15*a* and the upper boom 15*c*. The upper boom 15*c* is disposed on the most distal end side of the boom 15 among the parts forming the boom 15.

The mast 17 raises and lowers the boom 15. The mast 17 is mounted on the upper slewing body 13 so as to be raised and lowered. When the crane 1 is in a workable posture (working posture), the mast 17 is disposed on the rear side of the crane 1 (rear side of the upper slewing body 13) with respect to the boom 15. The mast 17 is rotatable with respect to the upper slewing body 13 about a rotation axis extending along the width direction. The mast 17 has a box structure. With respect to the mast 17, the width of a portion located on a proximal end side of the mast 17 with respect to a distal end portion of the mast 17 is larger than the width of the distal end portion of the mast 17 (similar to a front strut 32 (second rising and falling member) described later).

The jib 20 is mounted on the boom 15 so as to be raised and lowered. The jib 20 is mounted on the upper boom 15*c*. The jib 20 has a lattice structure (lattice jib). The jib 20 may have a box structure. The jib 20 includes a plurality of parts (parts forming the jib 20). The parts forming the jib 20 include a lower jib 21 (first rising and falling member), an intermediate jib 23, and an upper jib 25.

Figure 2:
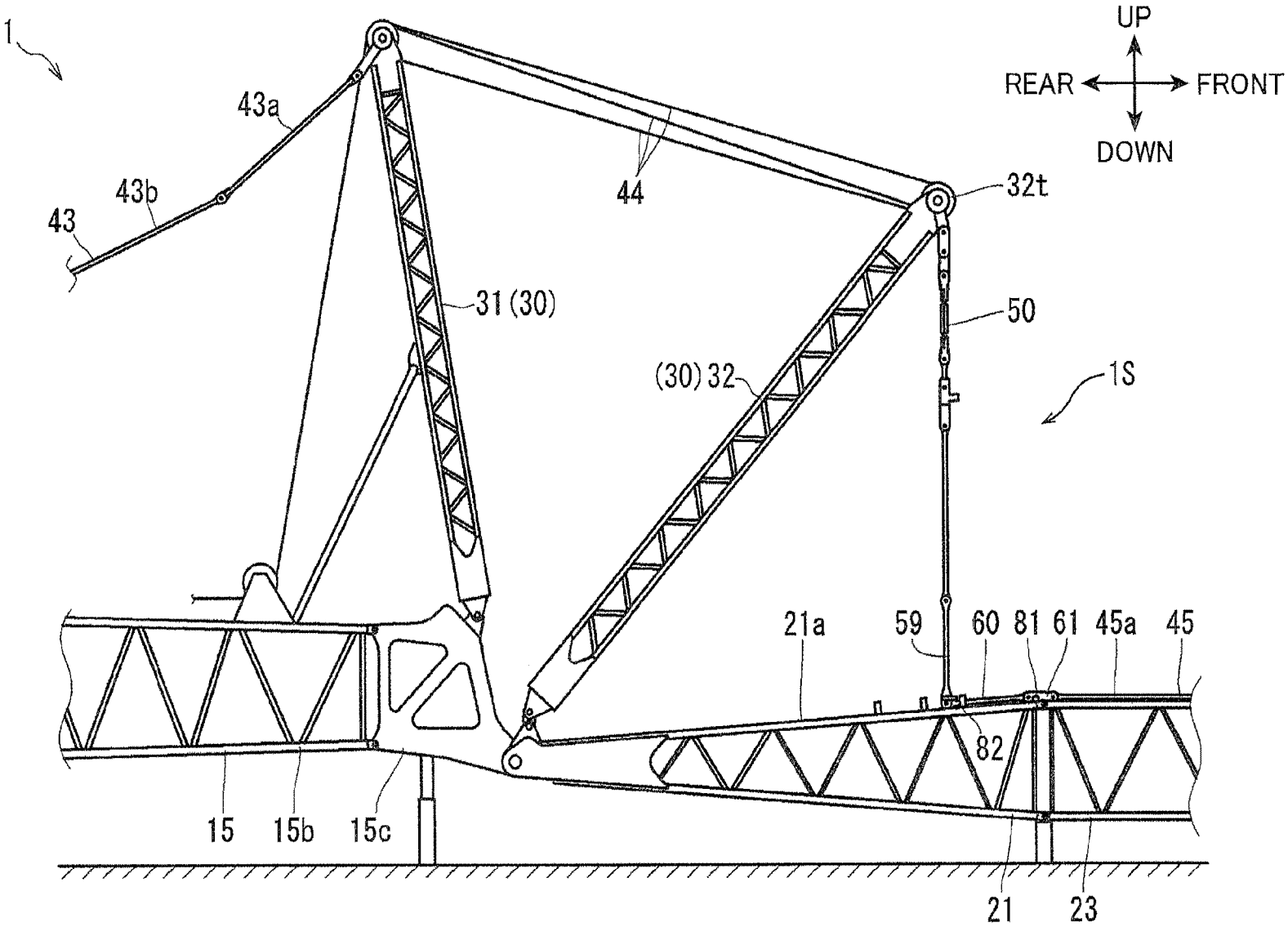
FIG. 2 is a view of a first rising and falling member, a second rising and falling member, a guy link, and the like shown in FIG. 1 as viewed along the lateral direction, and is a side view showing a state of a storing operation for storing a rising and falling body.
Figure 8:
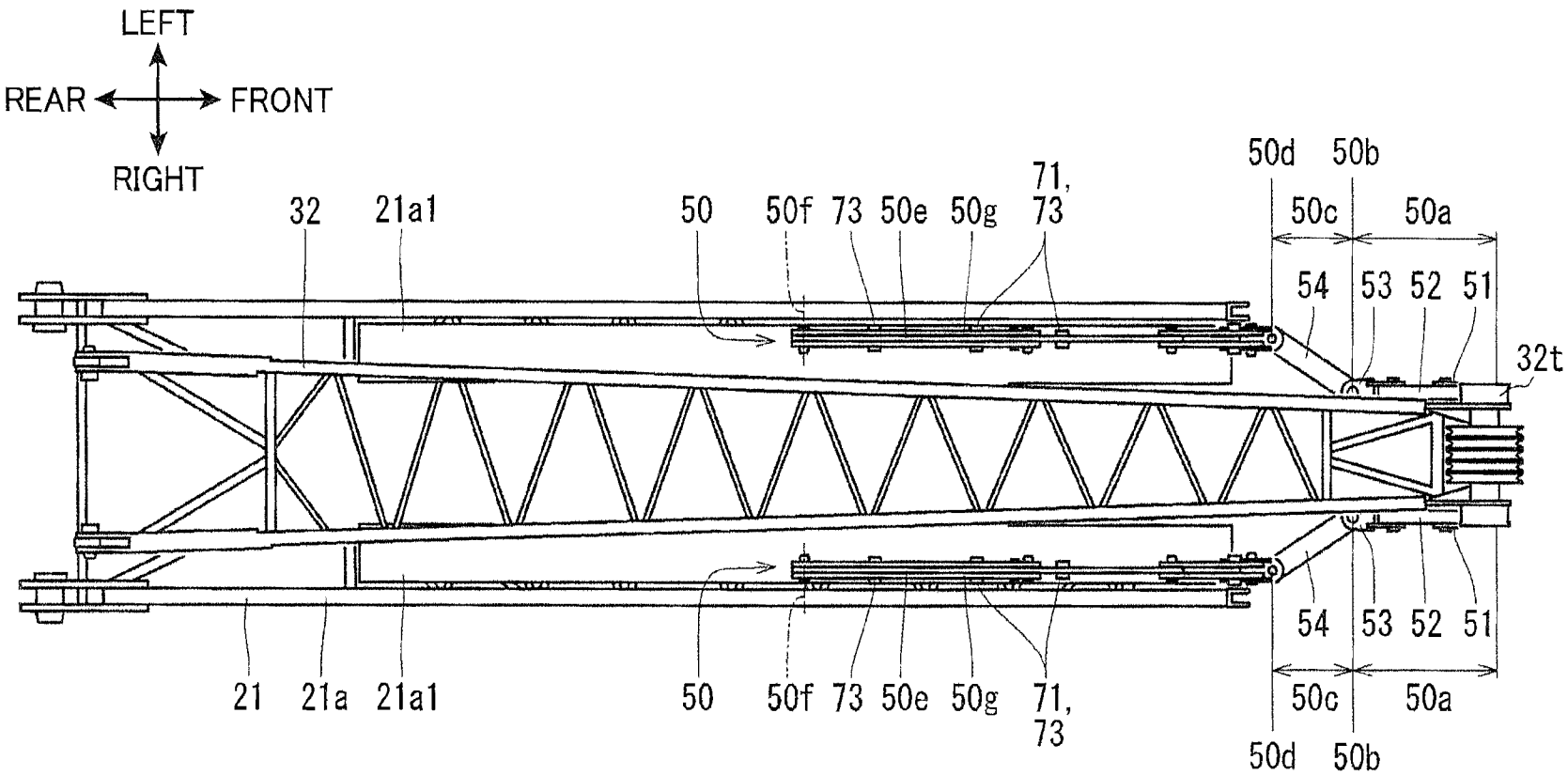
FIG. 8 is a top plan view of the rising and falling body as viewed in a direction indicated by an arrow F8 in FIG. 7.

The lower jib 21 (first rising and falling member) is mounted on the upper boom 15*c*, and is disposed on the most proximal end side of the jib 20 (upper boom 15*c* side) among the parts forming the jib 20. The lower jib 21 is mounted on the crane 1 so as to be raised or lowered about a horizontal first rotation axis. In a state where the lower jib 21 is mounted on the crane 1 (upper slewing body 13), the lower jib 21 has a predetermined width along the first width direction (the width direction, the lateral direction) parallel to the first rotation axis, and extends along the first longitudinal direction orthogonal to the first width direction. On the other hand, as shown in FIG. 2, the lower jib 21 may be disposed such that the first longitudinal direction of the lower jib 21 becomes a horizontal direction or a substantially horizontal direction. In this case, the axial direction (first longitudinal direction) of the lower jib 21 is assumed as a front-rear direction. In the front-rear direction, the direction extending from the proximal end side to the distal end side of the lower jib 21 (or simply the direction, the same is applied hereinafter) is defined as the front direction, and the direction opposite to the front direction is defined as the rear direction. The lower jib 21 has a substantially triangular prism shape, and has a substantially triangular shape when viewed along the width direction. Surfaces which form the lower jib 21 include a back surface 21*a*. The back surface 21*a* is a surface that becomes an upper surface (surface facing upward) of the lower jib 21 when the lower jib 21 is disposed such that the axial direction (longitudinal direction) of the lower jib 21 becomes the horizontal direction or the substantially horizontal direction. The back surface 21*a* is formed by pipes or the like. As shown in FIG. 8, the back surface 21*a* includes a platform 21*a*1. The platform 21*a*1 is configured such that an operator can stand on the platform 21*a*1. The platform 21*a*1 is a board, for example.

The intermediate jib 23 is disposed between the lower jib 21 and the upper jib 25 as shown in FIG. 1. The intermediate jib 23 is not necessarily provided. The upper jib 25 is disposed on the part on the most distal end side of the jib 20 among the parts forming the jib 20 (on the side opposite to the upper boom 15*c* side).

The strut 30 is a member for raising and lowering the jib 20. When the crane 1 is in the working posture, the strut 30 is disposed behind the lower jib 21 in the crane 1. The strut 30 includes a rear strut 31 and a front strut 32 (second rising and falling member). The rear strut 31 is mounted on the upper boom 15*c* so as to be raised and lowered. The rear strut 31 has a lattice structure, for example. The rear strut 31 may have a box structure, for example.

The front strut 32 (second rising and falling member) is mounted on the lower jib 21 so as to be raised or lowered. In other words, the front strut 32 has: a proximal end portion mounted on the crane 1 (lower jib 21) so as to be raised or lowered about a horizontal second rotation axis, and a distal end portion opposite to the proximal end portion. The front strut 32 has a predetermined width along the second width direction (the width direction, the lateral direction) parallel to the second rotation axis in a state where the front strut 32 is mounted on the crane 1 and extends along the second longitudinal direction orthogonal to the second width direction. The front strut 32 is mounted on the lower jib 21 at the position in the vicinity of a connecting portion (jib foot) where the lower jib 21 is connected to the upper boom 15*c*. The front strut 32 has, for example, a lattice structure. The front strut 32 may have, for example, a box structure.

Figure 7:
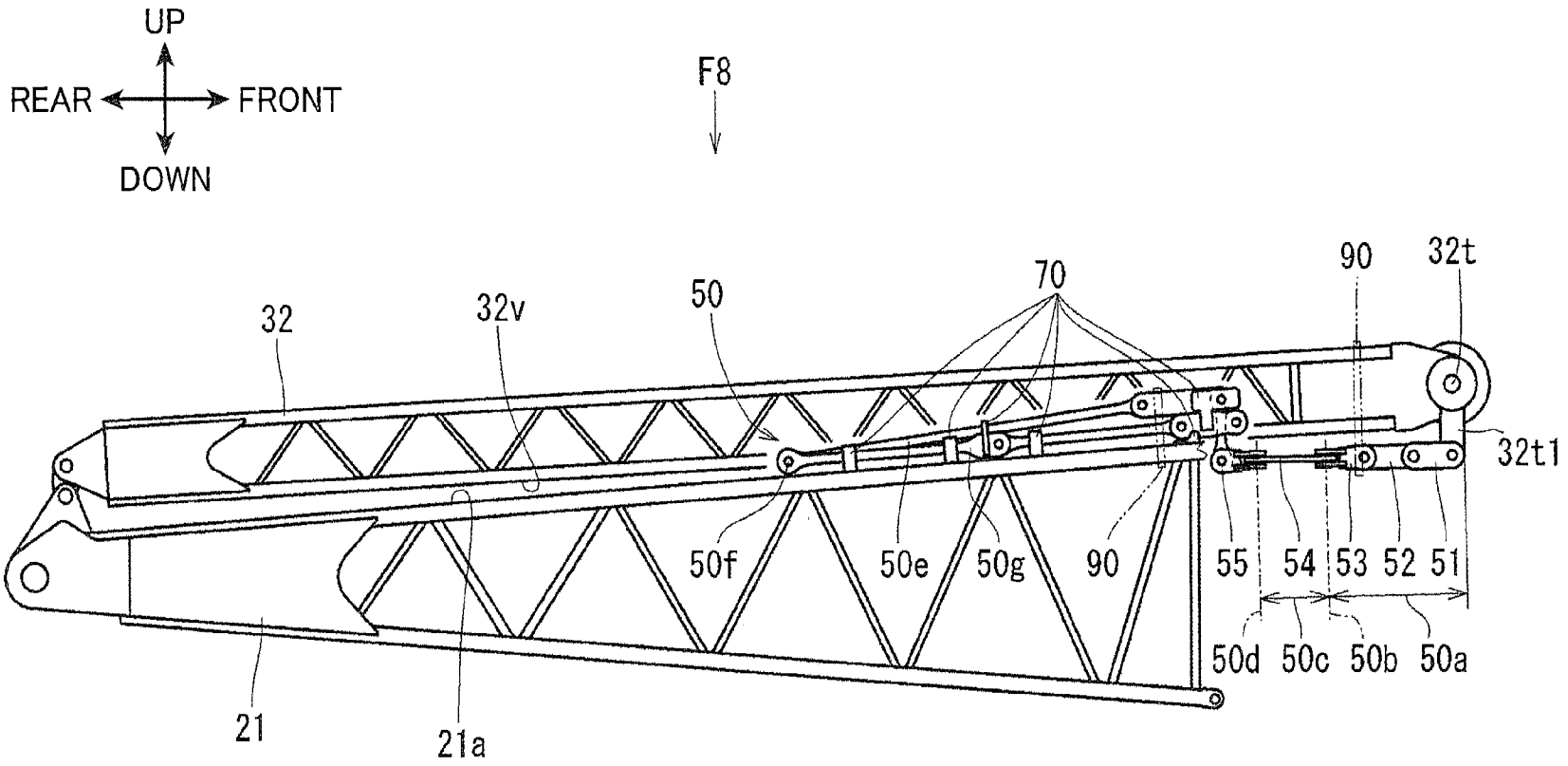
FIG. 7 is an enlarged side view showing the first rising and falling member, the second rising and falling member, the guy link, and the like shown in FIG. 6.

An end portion of the front strut 32 on the distal end side (the side opposite to the lower jib 21 side) is defined as a distal end portion 32*t*. The "end portion" includes the end and a portion around the end (the same is applied hereinafter). As shown in FIG. 8, the width (the size in the width direction (the same is applied hereinafter)) of a portion of the front strut 32 on the proximal end side (lower jib 21 side) with respect to the distal end portion 32*t* (the portion closer to the proximal end of the front strut 32 than to the distal end portion 32*t*) is larger than the width of the distal end portion 32*t*. For example, the width of the front strut 32 is gradually narrowed from the proximal end side toward the distal end side. The front strut 32 may have a portion where the width is not gradually narrowed from the proximal end side toward the distal end side. The front strut 32 may have a portion having a fixed width. As shown in FIG. 7, the distal end portion 32*t* includes a link connecting portion 32*t*1. The link connecting portion 32*t*1 is a portion to which the guy link 50 is connected.

The surfaces forming the front strut 32 include an abdominal surface 32*v*. The abdominal surface 32*v* is a surface that becomes a lower surface (a surface facing downward) when the front strut 32 is disposed such that the direction (longitudinal direction) of the center axis of the front strut 32 becomes the horizontal direction or the substantially horizontal direction. The abdominal surface 32*v* is formed of pipes or the like that connect side surfaces (outer surfaces in the width direction) of the front strut 32 to each other.

As shown in FIG. 1, the connecting member 40 is a member connected to the rising and falling member. The connecting member 40 includes a boom guy link 41, a boom raising and lowering rope 42, strut guy links 43, a jib raising and lowering rope 44, a jib guy link 45, and guy links 50.

The boom guy link 41 is connected to a distal end portion of the mast 17 and the distal end portion of the boom 15 (upper boom 15*c*). The boom guy link 41 is divided into a mast side portion 41*a* (boom basic guy link) and a boom side portion 41*b*. There is a case where the mast side portion 41*a*, the lower boom 15*a*, and the mast 17 are transported integrally. In this case, the mast side portion 41*a* may be transported while being stored in the lower boom 15*a* and the mast 17. The boom raising and lowering rope 42 is reeled in or out by a winch (not shown) mounted on the upper slewing body 13. The boom raising and lowering rope 42 is hung on a sheave mounted on the upper slewing body 13 and a sheave mounted on the distal end portion of the mast 17. When the boom raising and lowering rope 42 is reeled in or out by the winch, the mast 17 rises and lowers with respect to the upper slewing body 13 and hence, the boom 15 rises and lowers with respect to the upper slewing body 13.

The strut guy links 43 are connected to the strut 30 and the boom 15. That is, the strut guy links 43 are connected to a distal end portion of the rear strut 31 and the boom 15 (lower boom 15*a*). Each strut guy link 43 includes a width change link 43*a* and a boom side portion 43*b*. Two strut guy links 43 are disposed in a spaced-apart manner from each other in the width direction, and the width change links 43*a* are provided for changing a distance between two strut guy links 43 in the width direction. For example, the width change links 43*a* are formed such that the distance between two strut guy links 43 in the width direction is increased from the strut 30 side toward the boom 15 side. The boom side portions 43*b* are disposed at the position closer to the boom 15 than the width change links 43*a* are. The jib raising and lowering rope 44 is reeled in and out by a winch (not shown) mounted on the boom 15, for example. The jib raising and lowering rope 44 is hung on a sheave mounted on a distal end portion of the rear strut 31 and a sheave mounted on a distal end portion 32*t* of the front strut 32. By reeling in or out the jib raising and lowering rope 44 by the winch, a distance from the sheave on the rear strut 31 to the sheave on the front strut 32 is changed. As a result, the jib 20 is raised or lowered with respect to the boom 15.

The jib guy link 45 is connected to a distal end portion of the front strut 32 and a distal end portion of the jib 20 respectively. The jib guy link 45 includes a jib side portion 45*a* and the guy link 50 (jib basic guy link) which is a portion on the front strut 32 side. When the crane 1 is in a working posture, the jib side portion 45*a* is disposed closer to a distal end portion of the jib 20 than the guy link 50 is. As shown in FIG. 2, when the crane 1 is assembled or disassembled, the jib side portion 45*a* is placed on the intermediate jib 23 and the upper jib 25 (see FIG. 1). Two jib guy links 45 (guy links 50) are provided in a spaced apart manner from each other in the width direction.

The guy links 50 are mounted on a distal end portion 32*t* of the front strut 32. The guy links 50 are rotatable (swingable) with respect to the front strut 32 about a center axis extending along the width direction. The guy links 50 are connected to the link connecting portion 32*t*1. In the guy link 50, the side mounted on the front strut 32 is defined as a guy link 50 proximal end side (also simply referred to as "proximal end side"), and a side opposite to the guy link 50 proximal end side is defined as a guy link 50 distal end side (also simply referred to as "distal end side"). As shown in FIG. 1, when the crane 1 is in a working posture, the guy links 50 extend in a straight line shape. During a storing operation (see FIGS. 2 to 5) and during a stored state (see FIGS. 6 to 8), the guy link 50 is in a bent state at at least one portion. As shown in FIG. 7, the guy links 50, the lower jib 21, and the front strut 32 are integrally transported (details will be described later). The guy link 50 can be divided into the following parts based on the arrangement in a stored state. The guy link 50 includes, in the order from a proximal end side to a distal end side, a first link portion 50*a*, a first width direction bending portion 50*b* (first bending portion), a second link portion 50*c*, a second width direction bending portion 50*d* (second bending portion), a third link portion 50*e*, a folding portion 50*f* (storing and bending portion), and a fourth link portion 50*g*. The respective portions forming the guy link 50 are respectively formed of one or more link members.

In the present embodiment, the lower jib 21, the front strut 32, and the guy link 50 form the rising and falling body 1S (FIG. 2) of the present invention. The rising and falling body 1S is mounted on the upper slewing body 13 of the crane 1 and can change its state between a working state where the rising and falling body 1S performs predetermined work and a stored state where the rising and falling body 1S can be removed from the upper slewing body 13 and is transportable. In the working state, the lower jib 21 and the front strut 32 are mounted on the crane 1, and the guy link 50 is connected to the distal end portion of the front strut 32. In a stored state, the lower jib 21 is laid down, the front strut 32 is placed on the lower jib 21 so as to extend along the lower jib 21, the guy link 50 is supported by the distal end portion of the front strut 32, and at least a portion of the guy link 50 is supported by the lower jib 21.

Figure 13:
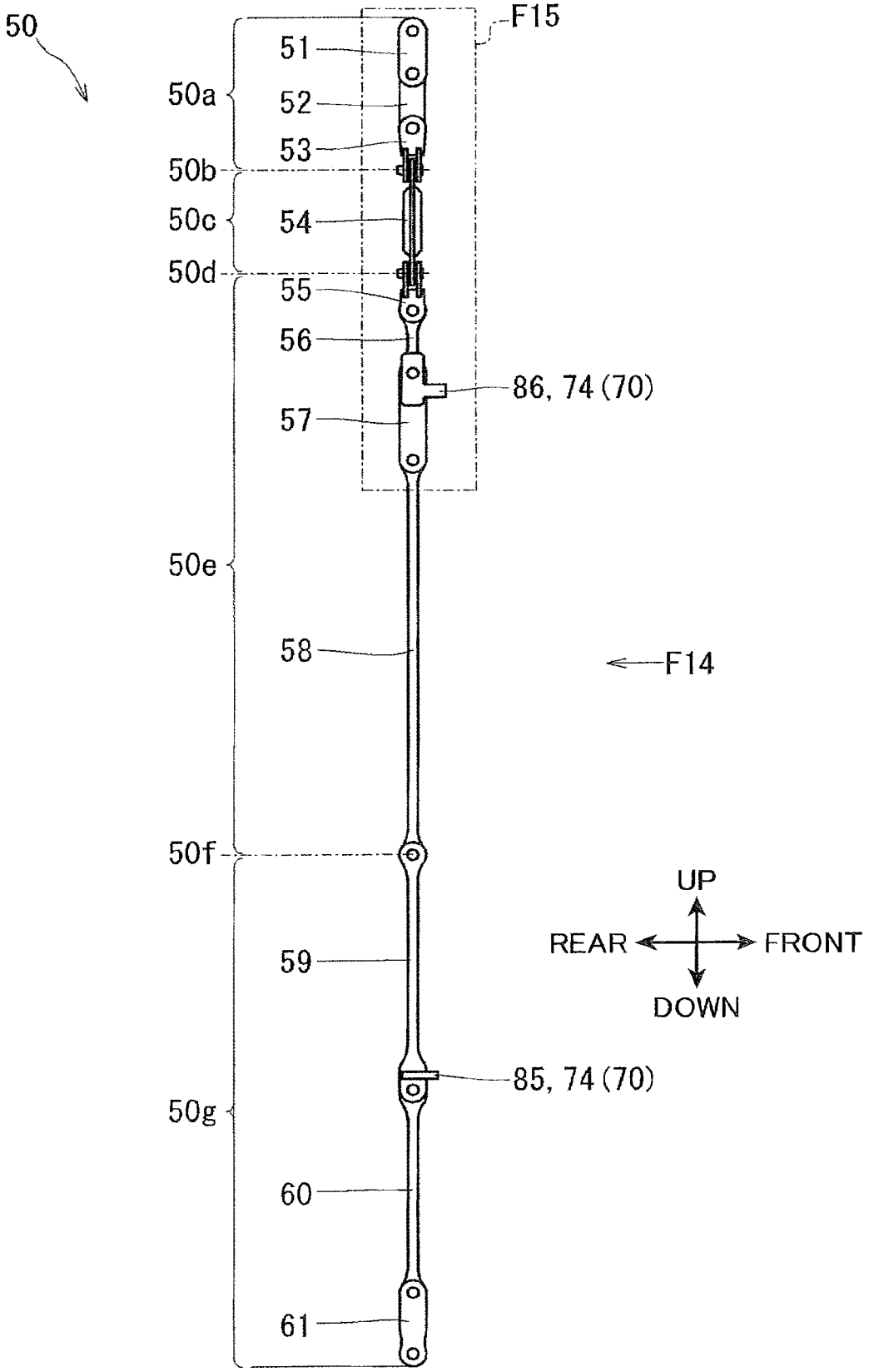
FIG. 13 is a side view of the guy link shown in FIG. 2 as viewed in the lateral direction.

The guy link 50 is formed by connecting a plurality of link members to each other (link configuration). The guy link 50 is formed by joining a plurality of link members to each other in a rotatable manner using pins. The direction of the rotation axis of the link members connected to each other is the width direction (excluding cross links described hereinafter). The number of link members forming the guy link 50 can be variously changed, and is 11 in the present embodiment. As shown in FIG. 13, the link members forming the guy link 50 include, in order from the proximal end side to the distal end side, a first link member 51 to an eleventh link member 61. More specifically, the guy link 50 includes a first link member 51, a second link member 52, a third link member 53, a fourth link member 54, a fifth link member 55, a sixth link member 56, a seventh link member 57, an eighth link member 58, a ninth link member 59, a tenth link member 60, and an eleventh link member 61.

Figure 14:
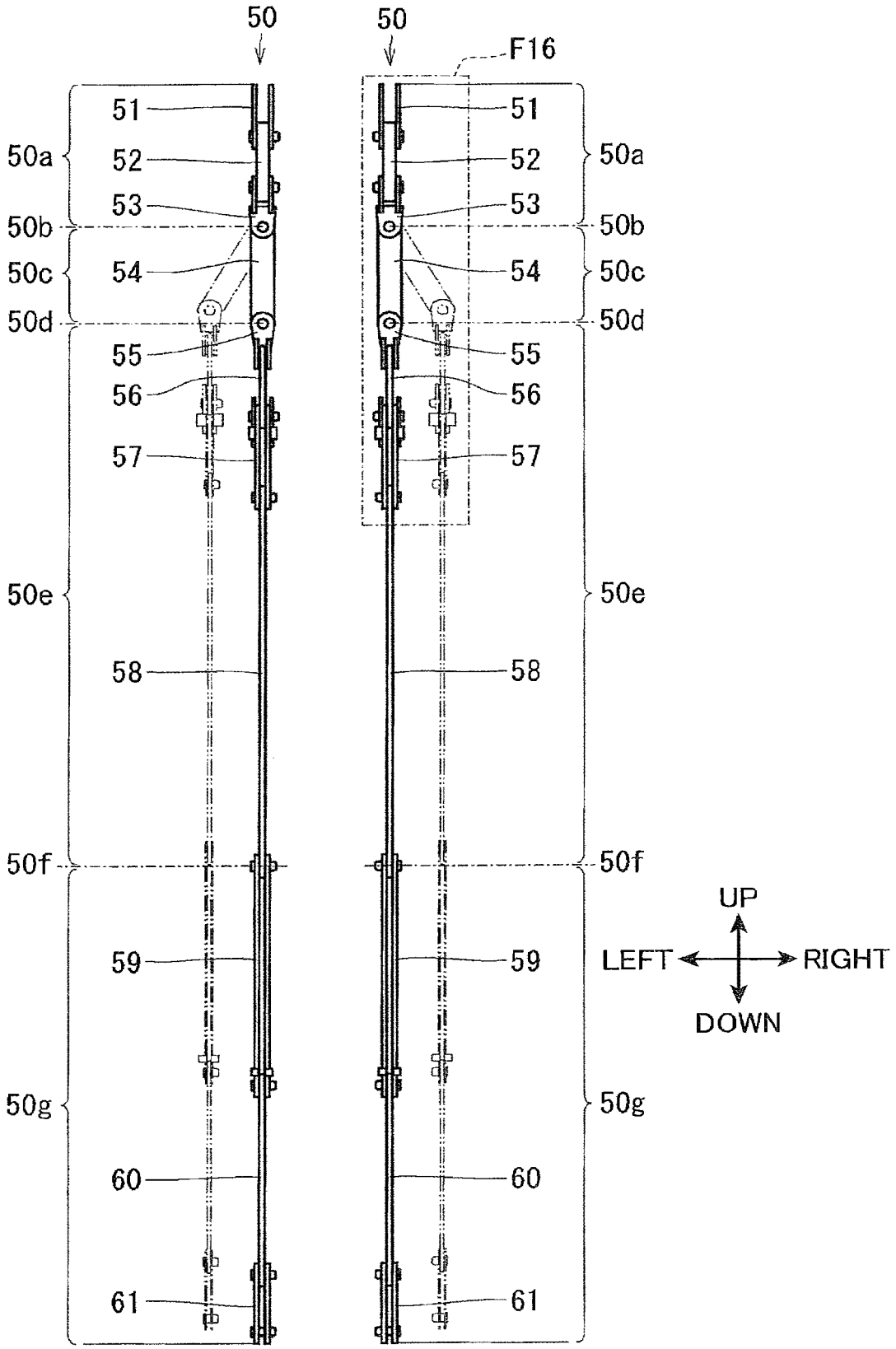
FIG. 14 is a front view taken along arrow F14 in FIG. 13.
Figure 15:
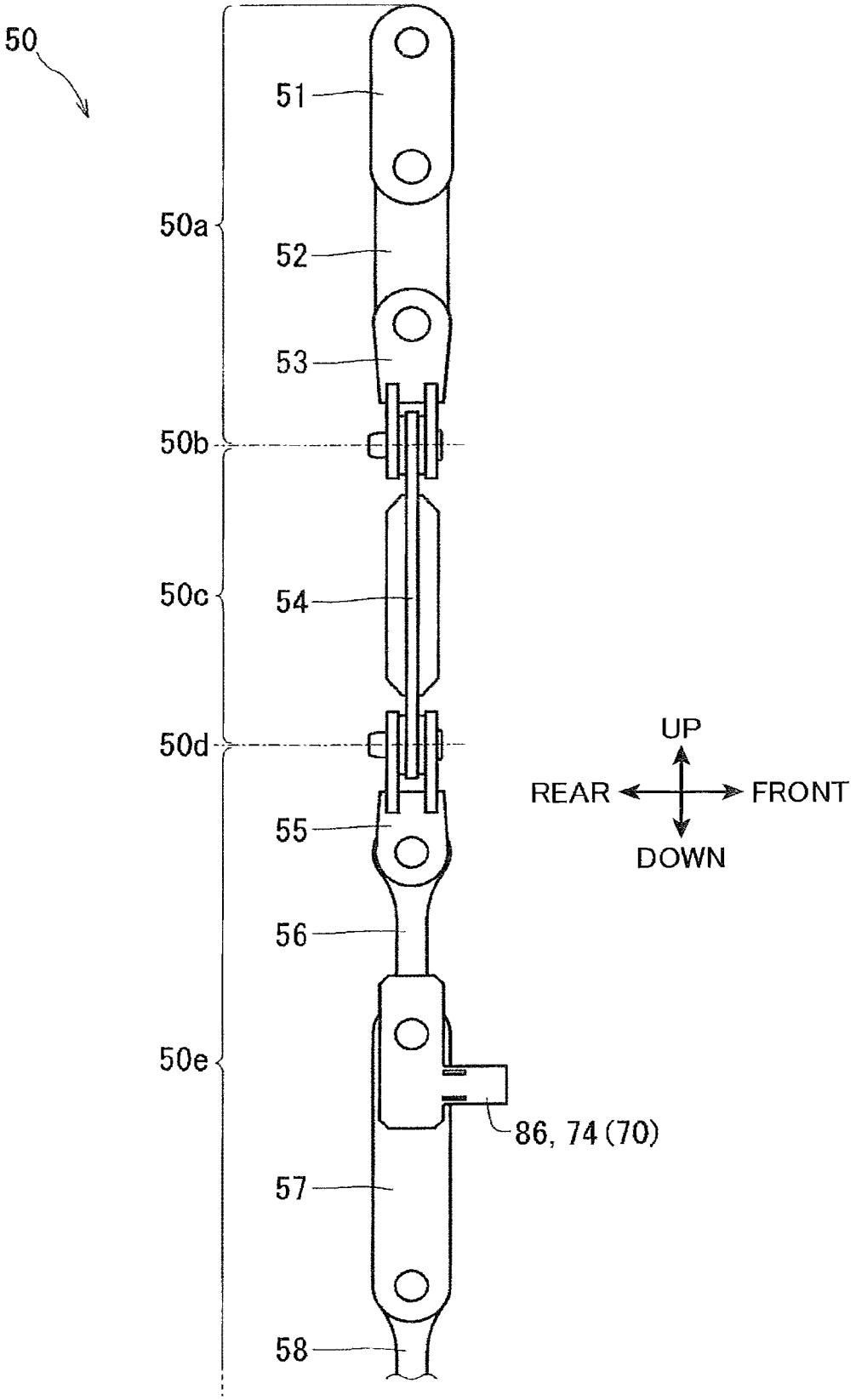
FIG. 15 is an enlarged view of a region F15 portion in FIG. 13.
Figure 16:
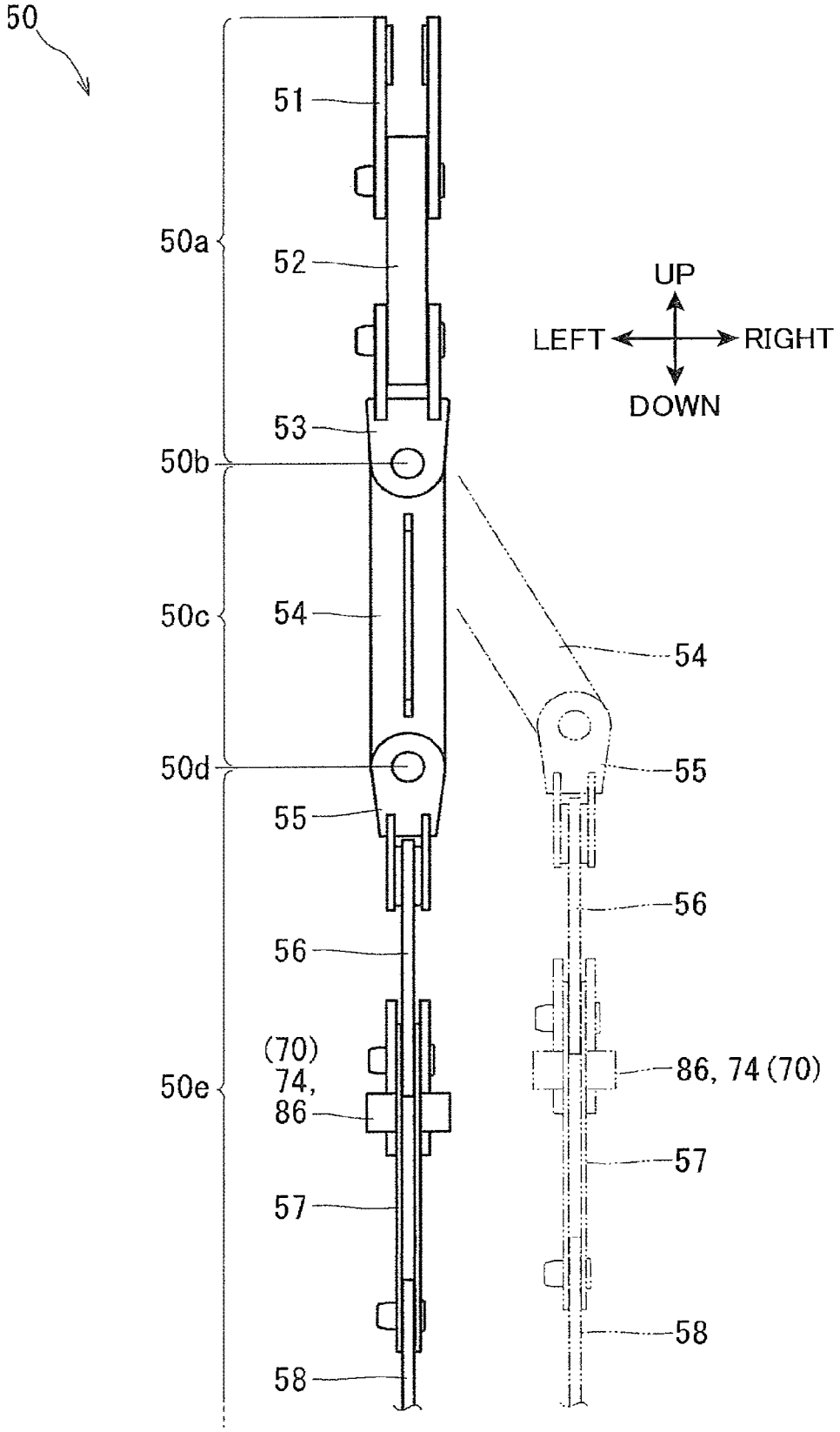
FIG. 16 is an enlarged view of a region F16 portion in FIG. 14.

Types of link members forming guy link 50 include a male link, a female link, and a cross link. The male link is a single plate-like link member. As shown in FIG. 14, the second link member 52, the fourth link member 54 (see FIG. 13), the sixth link member 56, the eighth link member 58, and the tenth link member 60 are respectively formed of a male link. The female link is formed of two plate-like link members, and sandwiches the male link. The first link member 51, the seventh link member 57, the ninth link member 59, and the eleventh link member 61 are respectively formed of a female link. As shown in FIG. 15, the third link member 53 and the fifth link member 55 are respectively formed of a cross link. The penetration directions of two pin holes formed in one cross link are set orthogonal to each other. One pin hole of one cross link penetrates along the width direction, and the other pin hole penetrates along the direction orthogonal to the width direction.

As shown in FIG. 7, the first link portion 50*a* is mounted on the link connecting portion 32*t*1 of the distal end portion 32*t* of the front strut 32. Specifically, the first link portion 50*a* is mounted on the distal end portion 32*t* of the front strut 32 so as to be swingable about a center axis extending in parallel with the second width direction. A first link portion 50*a* is a portion of the guy link 50 located on the proximal end side with respect to the first width direction bending portion 50*b*. For example, the first link portion 50*a* is formed of the first link member 51, the second link member 52, and the third link member 53 (cross link). The type and number of link members forming the first link portion 50*a* may be changed (the same is applied to portions other than the first link portion 50*a* such as the third link portion 50*e*).

As shown in FIG. 8, the first width direction bending portion 50*b* flexibly connects a portion of the guy link 50 located on the guy link 50 distal end side with respect to the first link portion 50*a* to the first link portion 50*a* in the width direction. For example, the first width direction bending portion 50*b* is formed of a coupling portion (rotation axis) between the third link member 53 (cross link) and the fourth link member 54.

The second link portion 50*c* is connected to the first link portion 50*a* by way of a first width direction bending portion

50*b*. The second link portion 50*c* is a portion of the guy link 50 that is located on the distal end side with respect to the first width direction bending portion 50*b* and is located on the proximal end side with respect to the second width direction bending portion 50*d*. In other words, the second link portion 50*c* is disposed at the position farther from the center axis of swing of the guy link 50 than the first link portion 50*a* is. For example, the second link portion 50*c* is formed of the fourth link member 54.

A second width direction bending portion 50*d* flexibly connects a portion of the guy link 50 located on the distal end side with respect to the second link portion 50*c* to the second link portion 50*c* in the width direction. For example, as shown in FIG. 14, the second width direction bending portion 50*d* is formed of a coupling portion (rotation axis) between the fourth link member 54 and the fifth link member 55 (cross link).

A third link portion 50*e* is connected to the second link portion 50*c* by way of the second width direction bending portion 50*d*. The third link portion 50*e* is a portion of the guy link 50 that is located on the distal end side with respect to the second width direction bending portion 50*d* and is located on the proximal end side with respect to the folding portion 50*f*. In other words, the third link portion 50*e* is disposed at a position farther from the center axis of swing of the guy link 50 than the second link portion 50*c* is. For example, the third link portion 50*e* includes the fifth link member 55, the sixth link member 56, the seventh link member 57, and the eighth link member 58.

As shown in FIG. 7, a folding portion 50*f* foldably (bendably) connects a portion located on the distal end side with respect to the folding portion 50*f* (fourth link portion 50*g* or the like) to a portion located on the proximal end side with respect to the folding portion 50*f* (third link portion 50*e* or the like) about a center axis extending along the width direction (second width direction). For example, as shown in FIG. 13, the folding portion 50*f* is formed of a coupling portion (rotation axis) between the eighth link member 58 and the ninth link member 59. The folding portion 50*f* allows the guy link 50 to be supported on the lower jib 21 in a state where the guy link 50 is folded at the folding portion 50*f* in the stored state.

As shown in FIG. 7, a fourth link portion 50*g* is connected to the third link portion 50*e* by way of a folding portion 50*f*. The fourth link portion 50*g* is a portion of the guy link 50 that is located on the distal end side with respect to the folding portion 50*f*. For example, as shown in FIG. 13, the fourth link portion 50*g* includes the ninth link member 59, the tenth link member 60, and the eleventh link member 61.

Figure 9:
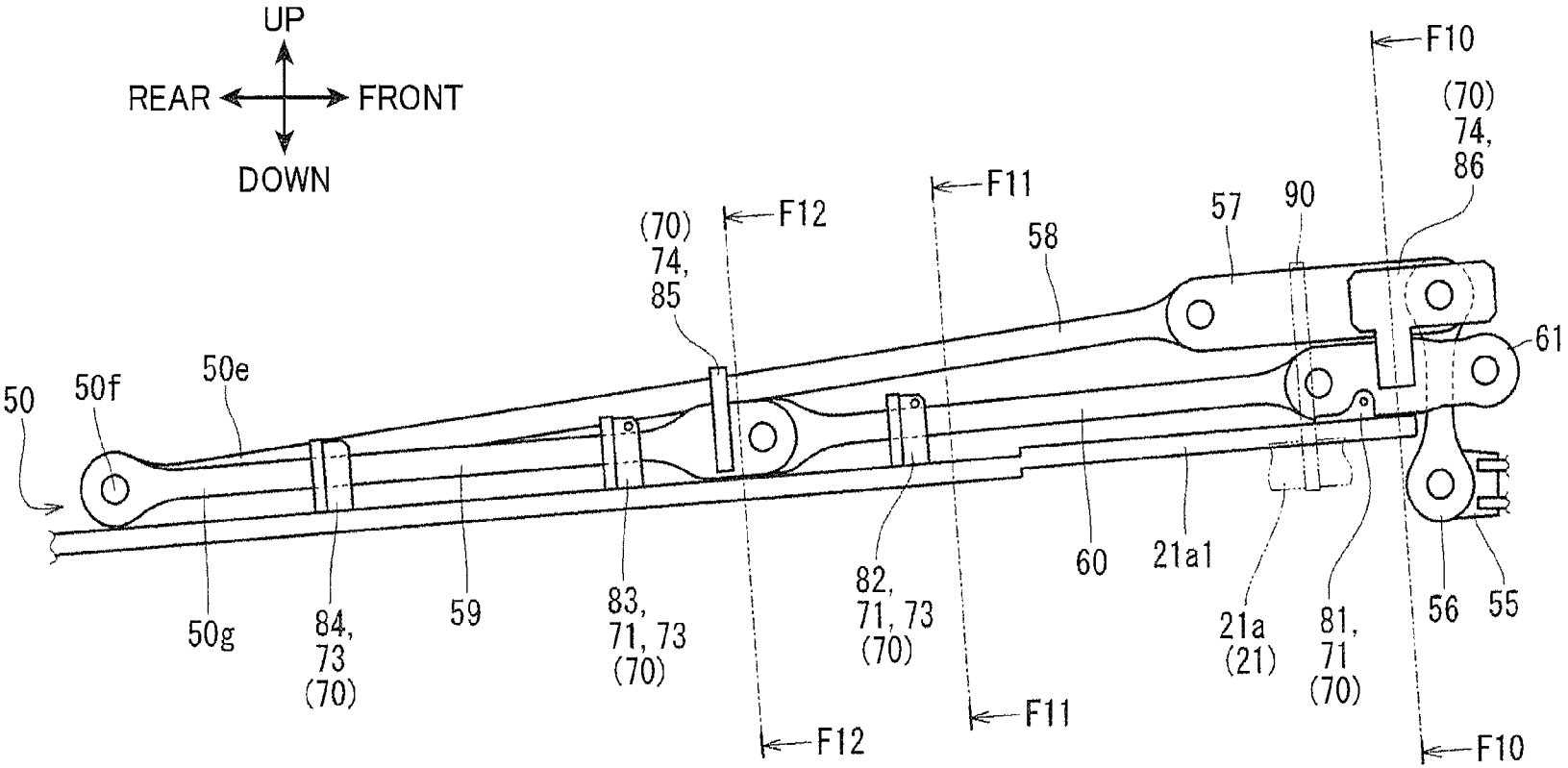
FIG. 9 is an enlarged side view showing the guy link and the like shown in FIG. 7 in an enlarged manner.

As shown in FIG. 7, receiving jigs 70 are portions that receive the guy link 50 in a stored state. As shown in FIG. 9, the receiving jig 70 is divided into a fixing jig 71, a first position correcting jig 73, and a second position correcting jig 74 based on their functions. The fixing jig 71, the first position correcting jig 73, and the second position correcting jig 74 are respectively formed of at least one of a first receiving jig 81, a second receiving jig 82, a third receiving jig 83, a fourth receiving jig 84, a fifth receiving jig 85, and a sixth receiving jig 86.

The fixing jig 71 fixes the guy link 50 to the lower jib 21 at a predetermined position (a position within a preliminary set range). The fixing jig 71 fixes the guy link 50 to the lower jib 21 with a pin, for example. The arrangement of the fixing jig 71 is as same as the arrangement of the first position correcting jig 73 (described later). For example, the fixing jig 71 is formed of the first receiving jig 81, the second receiving jig 82, and the third receiving jig 83. The number of the receiving jigs (the first receiving jig 81 and the like) forming the fixing jig 71 may be changed (the same is applied to the first position correcting jig 73 and the second position correcting jig 74).

The guy link 50 can be inserted into (can be received by) the first position correcting jig 73 (first reception jig) and the second position correcting jig 74 (second reception jig) respectively. The first position correcting jig 73 and the second position correcting jig 74 respectively guide and restrict the position of the guy link 50 in the width direction (lateral direction) when the guy link 50 is being inserted (during an inserting operation). The first position correcting jig 73 and the second position correcting jig 74 restrict (regulate) the position of the guy link 50 in the width direction when the guy link 50 has been inserted (when the insertion of the guy link 50 is completed).

The first position correcting jig 73 is mounted on the lower jib 21 and is fixed to the lower jib 21. The first position correcting jig 73 is mounted on the back surface 21*a*, for example, and is mounted on the platform 21*a*1, for example. As shown in FIG. 8, the first position correcting jig 73 is disposed at a position where the guy link 50 can be inserted into the first position correcting jig 73 when the guy link 50 is bent in the width direction. For example, the first position correcting jig 73 is disposed at a position where the guy link 50 can be inserted into the first position correcting jig 73 when the guy link 50 is offset outward in the width direction. The first position correcting jig 73 is disposed, for example, at an outer end portion in the width direction of the back surface 21*a*. The first position correcting jig 73 is disposed, for example, at an outer end portion in the width direction of the platform 21*a*1. As shown in FIG. 9, the first position correcting jig 73 protrudes upward from the back surface 21*a*. The first position correcting jig 73 is fixed to the lower jib 21 by a fastening member such as a bolt, for example (see FIG. 10). The first position correcting jig 73 may be mounted on the side surface of the lower jib 21. For example, the first position correcting jig 73 is formed of the second receiving jig 82, the third receiving jig 83, and the fourth receiving jig 84.

The second position correcting jig 74 is mounted on the guy link 50 and is fixed to the guy link 50. The guy link 50 can be inserted into the second position correcting jig 74 in a state where the guy link 50 is folded. The second position correcting jig 74 projects upward or downward from the guy link 50 in a state where the guy link 50 is folded. For example, the second position correcting jig 74 is formed of the fifth receiving jig 85 and the sixth receiving jig 86.

Figure 10:
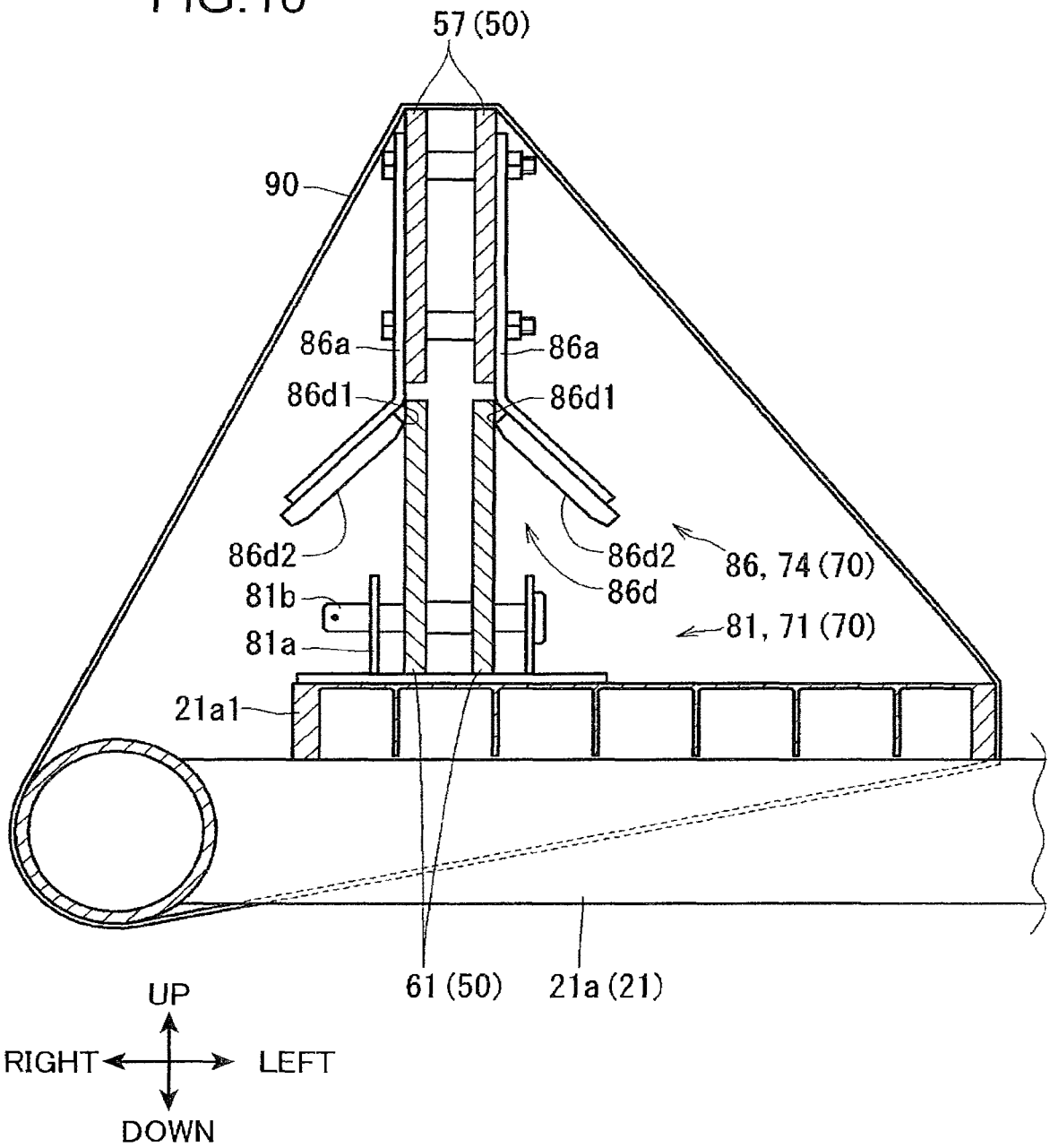
FIG. 10 is a cross-sectional view taken along arrows F10-F10 in FIG. 9.

The first receiving jig 81 forms the fixing jig 71. For example, the first receiving jig 81 fixes the eleventh link member 61 to the lower jib 21. As shown in FIG. 10, the first receiving jig 81 includes a frame portion 81*a* and a pin 81*b*. The frame portion 81*a* is fixed to the lower jib 21. The frame portion 81*a* includes two plate-like members disposed so as to sandwich the guy link 50 (for example, the eleventh link member 61) from the outside in the width direction. The pin 81*b* fixes the guy link 50 (the eleventh link member 61) to the first receiving jig 81. The pin 81*b* is inserted into the frame portion 81*a* and the guy link 50 (the eleventh link member 61). The number of the plate-like members for forming the first receiving jig 81 may be only one. The first receiving jig 81 may not include a plate-like member.

Figure 11:
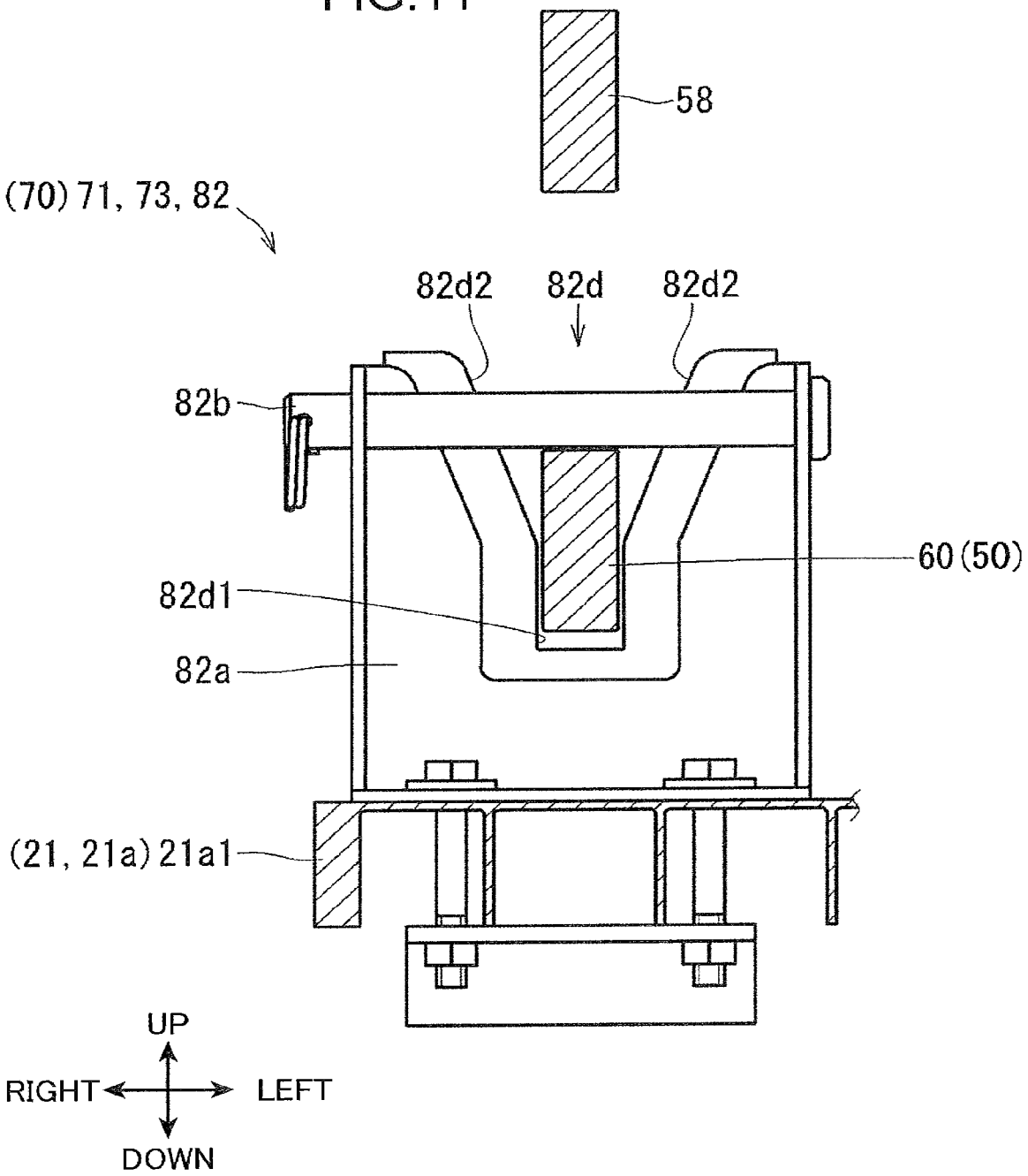
FIG. 11 is a cross-sectional view taken along arrows F11-F11 in FIG. 9.

As shown in FIG. 9, the second receiving jig 82 forms the fixing jig 71. The second receiving jig 82 also forms the first position correcting jig 73. The second receiving jig 82 is disposed behind the first receiving jig 81. For example, the tenth link member 60 is inserted into the second receiving jig 82. As shown in FIG. 11, the second receiving jig 82 includes a frame portion 82*a*, a pin 82*b*, and a recessed portion 82*d*. The frame portion 82*a* is fixed to the lower jib 21. The pin 82*b* fixes the guy link 50 (for example, the tenth link member 60) to the second receiving jig 82. The pin 82*b* is inserted into the frame portion 82*a* at a position above the guy link 50 (tenth link member 60). The pin 82*b* restricts the upward movement of the guy link 50 (tenth link member 60).

The recessed portion 82*d* is a portion having an indented shape on the side (lower side) into which the guy link 50 is inserted. The recessed portion 82*d* is formed so that the guy link 50 can easily slide. The recessed portion 82*d* is formed of, for example, a resin. The recessed portion 82*d* has a storing portion 82*d*1 and inclined portions 82*d*2.

The storing portion 82*d*1 (first restraining portion) is a portion in which the guy link 50 is stored. Inner surfaces of the storing portion 82*d*1 on both sides in the width direction extend in the vertical direction. The size of the storing portion 82*d*1 in the width direction (the distance between the inner surfaces of the storing portion 82*d*1 on both sides in the width direction) is substantially equal to the size in the width direction of the guy link 50 (for example, the tenth link member 60) inserted into the storing portion 82*d*1. The storing portion 82*d*1 restrains the guy link 50 in the width direction (second width direction).

The inclined portions 82*d*2 (first guide portions) guide the position of the guy link 50 in the width direction. More specifically, the inclined portions 82*d*2 are formed such that, when the guy link 50 is inserted into the recessed portion 82*d*, the guy link 50 is stored in the storing portion 82*d*1 by being moved (slid) in the width direction along the inclined portions 82*d*2. That is, the inclined portions 82*d*2 guide the guy link 50 toward the storing portion 82*d*1. The inclined portions 82*d*2 are formed on both surfaces (left and right inner surfaces) of the recessed portion 82*d* in the width direction. The inclined portions 82*d*2 are inclined with respect to the direction (vertical direction) in which the guy link 50 is inserted. The inclined portions 82*d*2 are inclined with respect to the direction (vertical direction) that the guy link 50 is inserted such that the distance between the inclined portions 82*d*2 on both sides in the width direction becomes narrower toward the side where the guy link 50 is inserted (downward direction).

The third receiving jig 83 is formed substantially in the same manner as the second receiving jig 82 shown in FIG. 9. The difference between the third receiving jig 83 and the second receiving jig 82 will be described. The third receiving jig 83 is disposed behind the second receiving jig 82. For example, the ninth link member 59 is inserted into the third receiving jig 83. A male link (tenth link member 60) is inserted into the second receiving jig 82. On the other hand, a female link (ninth link member 59) is inserted into the third receiving jig 83. Therefore, the size in the width direction of the storing portion of the third receiving jig 83 (see the storing portion 82*d*1 shown in FIG. 11) is larger than the size in the width direction of the storing portion 82*d*1 of the second receiving jig 82. The third receiving jig 83 may not form the fixing jig 71 and may not have a pin (see the pin 82*b* shown in FIG. 11).

The fourth receiving jig 84 is formed substantially in the same manner as the third receiving jig 83. The fourth receiving jig 84 is described with respect to the difference between the fourth receiving jig 84 and the third receiving jig 83. The fourth receiving jig 84 does not form the fixing jig 71 and does not have a pin (see the pin 82*b*). The fourth receiving jig 84 is disposed behind the third receiving jig 83.

Figure 12:
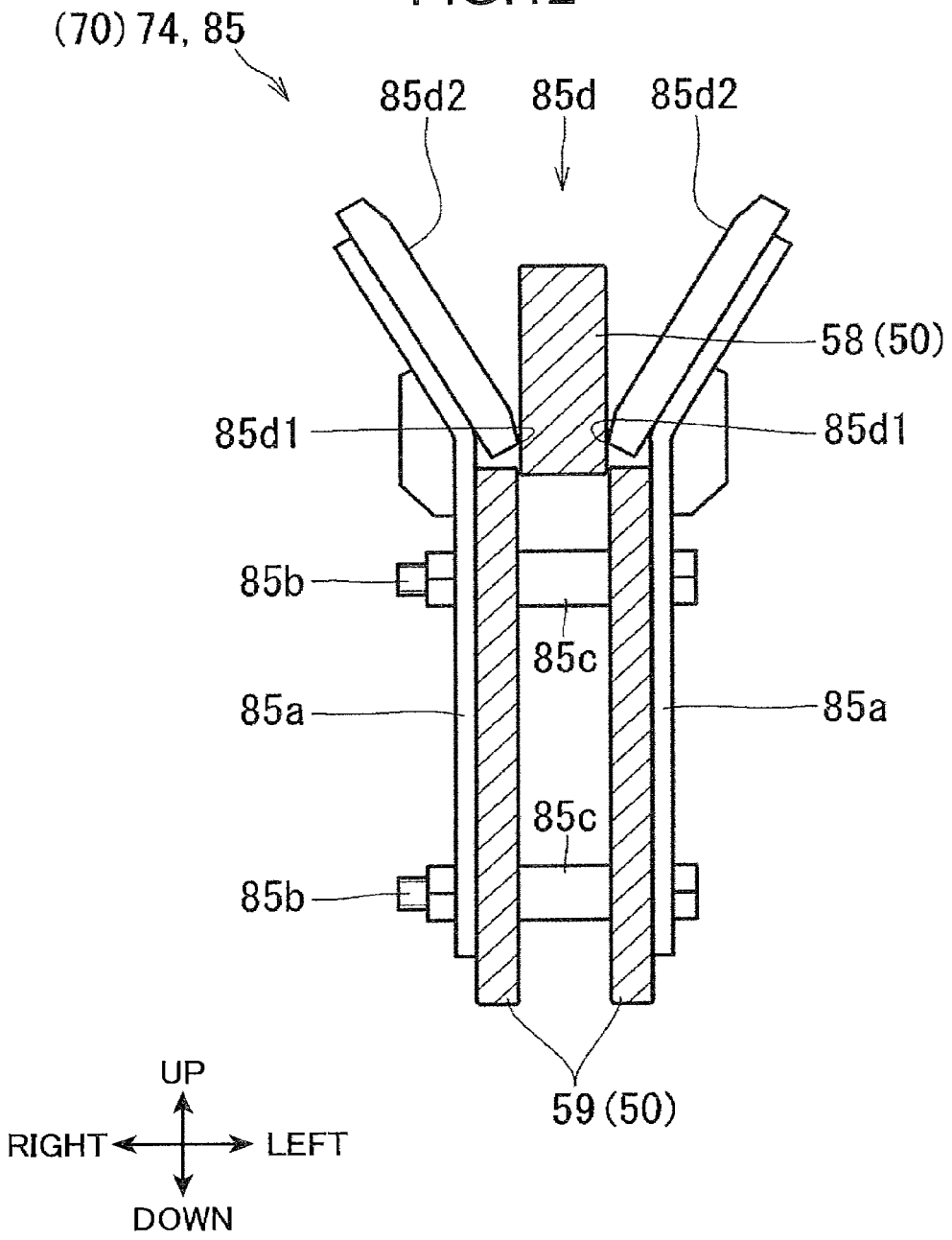
FIG. 12 is a cross-sectional view taken along arrows F12-F12 in FIG. 9.

The fifth receiving jig 85 is formed substantially in the same manner as the second receiving jig 82. The fifth receiving jig 85 is mounted on one portion of the guy link 50 and can receive the other portion of the guy link 50 when the guy link 50 is folded in the stored state. The fifth receiving jig 85 is described mainly with respect to the difference between the fifth receiving jig 85 and the second receiving jig 82. The fifth receiving jig 85 forms the second position correcting jig 74. However, the fifth receiving jig 85 does not form the first position correcting jig 73, and also does not form the fixing jig 71. The fifth receiving jig 85 may form the fixing jig 71. The fifth receiving jig 85 protrudes upward from the guy link 50 (for example, the ninth link member 59). For example, the eighth link member 58 is inserted into the fifth receiving jig 85. As shown in FIG. 12, the fifth receiving jig 85 includes a frame portion 85*a*, a bolt 85*b*, a connecting portion 85*c*, and a recessed portion 85*d*.

The frame portion 85*a* is fixed to the guy link 50. For example, the frame portion 85*a* is fixed to the ninth link member 59. The frame portion 85*a* is fixed to the side surface (outer surface in the width direction) of the guy link 50. That is, the frame portions 85*a* are fixed to both (left and right) side surfaces of the guy link 50 respectively. The bolt 85*b* (fastening member) is a member that fixes the frame portions 85*a* to the guy link 50 by fastening. A connecting portion 85*c* connects plates forming female links (the ninth link member 59) to each other along the width direction. The connecting portion 85*c* has a function of preventing the ninth link member 59 from falling down (described later). For example, the connecting portion 85*c* is formed of a cylindrical portion that allows the bolt 85*b* to pass through the connecting portion 85*c*. The recessed portion 85*d* includes a storing portion 85*d*1 (second restraining portion) and inclined portions 85*d*2 (second guide portions). As shown in FIG. 11, in the second receiving jig 82, the inner surfaces of the storing portions 82*d*1 on both sides in the width direction extend in the vertical direction. On the other hand, as shown in FIG. 12, in the fifth receiving jig 85, the storing portions 85*d*1 are formed by the lower end portions of the inclined portions 85*d*2. In the fifth receiving jig 85, the distance in the width direction between the lower end portions of the inclined portions 85*d*2 is substantially the same as the size in the width direction of the guy link 50 (for example, the eighth link member 58) inserted into the fifth receiving jig 85. The inclined portions 85*d*2 are formed in the same manner as the inclined portions 82*d*2 (see FIG. 11) of the second receiving jig 82. The inclined portions 85*d*2 guide the other portion of the guy link 50 toward the storing portion 85*d*1. The storing portion 85*d*1 restrains the other portion of the guy link 50 in the width direction (second width direction).

The sixth receiving jig 86 is formed substantially in the same manner as the fifth receiving jig 85, as shown in FIG. 9. The sixth receiving jig 86 is described mainly with respect to the difference between the sixth receiving jig 86 and the fifth receiving jig 85. The sixth receiving jig 86 protrudes downward from the guy link 50 (for example, the seventh link member 57). For example, the eleventh link member 61 is inserted into the sixth receiving jig 86. As shown in FIG. 10, the sixth receiving jig 86 includes frame portions 86*a* and a recessed portion 86*d*. The frame portions 86*a* are fixed to the seventh link member 57, for example. The recessed portion 86*d* is disposed upside down in the vertical direction with respect to the recessed portion 85*d* (see FIG. 12) of the fifth receiving jig 85. The recessed portion 86*d* includes storing portions 86*d*1 and inclined portions 86*d*2. The storing portions 86*d*1 are formed in the same manner as the storing portions 85*d*1 (see FIG. 12) of the fifth receiving jig 85. The inclined portions 86*d*2 are inclined with respect to the direction (vertical direction) that the guy link 50 is inserted such that the distance in the width direction between the inclined portions 86*d*2 on both sides in the width direction is narrowed toward the side (upper side) that the guy link 50 is inserted.

Figure 6:
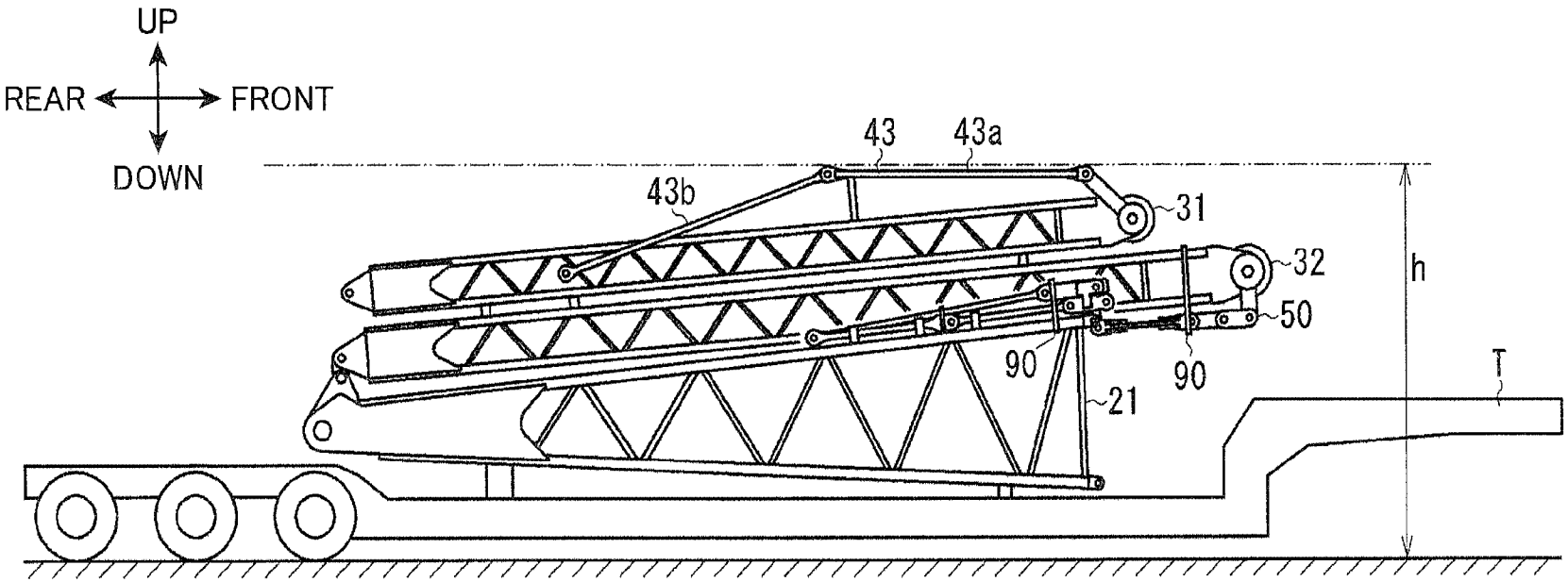
FIG. 6 is a view of the first rising and falling member, the second rising and falling member, the guy link and the like shown in FIG. 5 as viewed in the lateral direction, and is a side view showing a state during transportation of the rising and falling body.

A tightly fastening member 90 is a member for tightly fastening the guy link 50 to the lower jib 21 and the front strut 32 as shown in FIG. 6. For example, the tightly fastening member 90 is a string-like member, and is at least one of a band, a belt, a wire, and a chain.

When the crane 1 (the rising and falling body 1S) is in a working state, at least a portion of the guy link 50 connected to the distal end portion of the front strut 32 is included in a plane which passes through a portion of the front strut 32 and is orthogonal to a center axis of swing of the guy link 50. That is, when the guy link 50 is directly swung toward the front strut 32 side in shifting a state of the crane 1 from a working state to a stored state, there is a concern that a portion of the guy link 50 interferes with the abdominal surface 32*v* of the front strut 32. In this case, in a stored state, the guy link 50 is interposed between the lower jib 21 and the front strut 32 in the vertical direction. However, in the present embodiment, such a problem is solved by the characteristic structure which the guy link 50 possesses.

(Arrangement in Stored State)

The arrangement of the lower jib 21, the front strut 32, and the guy links 50 in a stored state is as follows. The axial direction (longitudinal direction) of the lower jib 21 is the horizontal direction or the substantially horizontal direction. The front strut 32 is placed on the lower jib 21. That is, the front strut 32 is placed on the back surface 21*a* of the lower jib 21. The axial direction (longitudinal direction) of the front strut 32 is parallel to or substantially parallel to the back surface 21*a* of the lower jib 21. The back surface 21*a* of the lower jib 21 and the abdominal surface 32*v* of the front strut 32 are parallel to each other or substantially parallel to each other, and the back surface 21*a* and the abdominal surface 32*v* face each other. As shown in FIG. 8, the front strut 32 is disposed at the center portion of the lower jib 21 in the width direction. The width (size in the width direction) of the front strut 32 is narrower than the width of the lower jib 21. Therefore, spaces in each of which the guy link 50 can be disposed are formed outside the front strut 32 in the width direction and above the back surface 21*a* of the lower jib 21.

In a stored state, at least a portion (for example substantially the whole) of the guy link 50 is disposed outside the front strut 32 in the width direction. A portion of the guy link 50 may be disposed at the position at which the portion overlaps with the front strut 32 when viewed along the vertical direction. For example, the guy link 50 may be disposed at the position in front of the lower jib 21 where the guy link 50 overlaps with the front strut 32 when viewed in the vertical direction (for example, see the second link member 52 and the third link member 53 shown in FIG. 8). The guy link 50 is disposed (mounted or stored) on the back surface 21*a* (upper surface) of the lower jib 21. For example, the guy link 50 may be disposed (stored) on the side surface (the outer surface in the width direction) of the lower jib 21. The guy link 50 may be disposed outside the side surface of the lower jib 21 in the width direction, or may be disposed along the side surface of the lower jib 21.

In a stored state, at least a portion of the guy link 50 is disposed outside the front strut 32 in the width direction. Therefore, a structural body (for example, pipes or the like which form the abdominal surface 32*v*) can be disposed at the center portion in the width direction of the front strut 32. Therefore, the front strut 32 can have the single lattice structure. The manner of operation and advantageous effects obtained by adopting such a structure are as follows. It is also conceivable that the front strut 32 has a structure having two structural bodies (for example, box structural bodies) spaced apart from each other in the width direction. In this case, it is conceivable to store the guy link 50 between two structural bodies (in the width direction). However, in the case where the front strut 32 has the structure where two structural bodies are spaced apart from each other in the width direction and these two structural bodies (for example, distal end portions of two structural bodies) are connected to each other by a structural body, there is a concern that a cost may be higher compared to the case where one lattice structure is adopted. On the other hand, in the present embodiment, the guy links 50 are stored outside in the width direction with respect to the front strut 32, the front strut 32 can be formed of a member having one lattice structure. Therefore, a cost of the front strut 32 can be suppressed. As a modification, the front strut 32 may have a structure having two structural bodies spaced apart from each other in the width direction.

In a stored state, the guy link 50 is bent at the first width direction bending portion 50*b*. The guy link 50 is preferably bent at the second width direction bending portion 50*d*. It is preferable that a portion of the guy link 50 located on the distal end side (rear side portion) with respect to the second width direction bending portion 50*d* be disposed so as to extend in parallel or substantially parallel to the axial direction of the lower jib 21.

In a stored state, as shown in FIG. 7, the guy link 50 is folded about a center axis (folding portion 50*f*) extending along the width direction. The guy link 50 is disposed such that a portion of the guy link 50 that is located on the proximal end side with respect to the folding portion 50*f* (third link portion 50*e* or the like) and a portion on the distal end side (fourth link portion 50*g*) overlap with each other in the vertical direction (for example, the portions being disposed substantially parallel to each other).

(Manner of Operation)

As shown in FIG. 1, an operation of shifting the posture of the crane 1 from the working posture to the posture in which the lower jib 21, the front strut 32 and the guy link 50 are stored (stored state) as shown in FIG. 7 (a storing operation, a method for storing a rising and falling body of a work machine) is performed as follows. Hereinafter, the above-mentioned operation is described in accordance with steps of the operation. The order of steps of the operation may be changed.

(Preparation Step)

As the guy link 50, the structure is prepared which includes: the first link portion 50*a* mounted on the distal end portion 32*t* of the front strut 32 so as to be swingable about the center axis extending in the width direction parallel to the rotation axis of the front strut 32; the second link portion 50*c* disposed at a position farther from the center axis of swing of the guy link 50 than the first link portion 50*a* is; and the first width direction bending portion 50*b* that connects the first link portion 50*a* and the second link portion 50*b* so that the second link portion 50*c* is bendable in the width direction with respect to the first link portion 50*a*.

More preferably, as the guy link 50, the structure is prepared by further including: the third link portion 50*e* disposed at a position farther from the center axis than the second link portion 50*c* is; and the second width direction bending portion 50*d* connecting the second link portion 50*c* and the third link portion 50*e* so that the third link portion 50*e* is bendable in the width direction with respect to the second link portion 50*c*.

More preferably, the first position correcting jig 73 is further prepared in which the first position correcting jig 73 is mounted on the lower jib 21 and is capable of receiving the guy link 50, the first position correcting jig 73 including: the storing portion 82*d*1 for restraining the guy link 50 in the width direction; and the inclined portions 82*d*2 for guiding the guy link 50 toward the storing portion 82*d*1. More preferably, the second position correcting jig 74 is further prepared in which the second position correcting jig 74 is mounted on one portion of the guy link 50 and is capable of receiving the other portion of the guy link 50 when the guy link 50 is in a folded state, the second position correcting jig 74 including: the storing portion 85*d*1 for restraining the other portion of the guy link 50 in the width direction; and the inclined portions 85*d*2 for guiding the other portion of the guy link 50 toward the storing portion 85*d* 1.

(Guy Link Suspending Step)

As shown in FIG. 2, a state is brought about that the lower jib 21 is laid down, the front strut 32 is disposed above the lower jib 21, and the guy link 50 is suspended from the distal end portion of the front strut 32 (guy link suspending step). The details of this step are as follows.

As shown in FIG. 1, the posture of the crane 1 is shifted from a working posture to the posture where the boom 15 and the jib 20 are laid down as shown in FIG. 2 and are brought into contact with a ground as shown in FIG. 2. This ground contact may be direct contact or indirect contact (for example, the ground contact by way of a table). At this stage, both the axial direction of the boom 15 and the axial direction of the jib 20 are a horizontal direction or a substantially horizontal direction.

The front strut 32 is disposed above the lower jib 21. At this stage, a state is brought about where the front strut 32 is raised with respect to the lower jib 21 and is disposed above the lower jib 21 such that the distal end portion 32*t* is located on the more front side and at a higher position than the proximal end portion of the front strut 32 (frontwardly inclined state). In this state, when the jib raising and lowering rope 44 is reeled out, the distal end portion 32*t* of the front strut 32 moves downward. This operation is referred to as "the front strut 32 is lowered".

The jib side portion 45*a* of the jib guy link 45 is placed on the intermediate jib 23 and the upper jib 25 (see FIG. 1). A state is brought about where the guy link 50 is suspended from the front strut 32. At this stage, it is sufficient that at least a portion of the guy link 50 is suspended from the front strut 32. At this stage, the distal end side portion (for example, the eleventh link member 61) of the guy link 50 may be placed on the lower jib 21.

The intermediate jib 23 is separated from the lower jib 21. When the intermediate jib 23 is not used, the upper jib 25 (see FIG. 1) is separated from the lower jib 21. The jib side portion 45*a* of the jib guy link 45 is separated from the guy link 50.

(Bending Step)

Next (after the guy link suspending step), as shown in FIG. 14, the guy link 50 is bent at the first width direction bending portion 50*b* (first bending step). Furthermore, it is preferable that the guy link 50 is bent at the second width direction bending portion 50*d* (second bending step). The details of this step are as follows.

In the first bending step, the distal end portion of the front strut 32 is lowered, and a portion of the guy link 50 that is located on the distal end side with respect to the first width direction bending portion 50*b* (second link portion 50*c* or the like) is bent at the first width direction bending portion 50*b* so as to be disposed on the outer side in the width direction with respect to the first link portion 50*a*. Specifically, in the first bending step, a portion of the guy link 50 that is located on the distal end side with respect to the first width direction bending portion 50*b* (such as the second link portion 50*c*) is bent outward in the width direction with respect to the longitudinal direction of the first link portion 50*a*. In the second bending step, the guy link 50 is bent at the second width direction bending portion 50*d* such that the portion of the guy link 50 that is located on the distal end side with respect to the second width direction bending portion 50*d* (such as the third link portion 50*e*) is disposed inside in the width direction with respect to the longitudinal direction of the second link portion 50*c* (with respect to a straight line connecting the first width direction bending portion 50*b* and the second width direction bending portion 50*d*).

Through the first bending step and the second bending step, the guy links 50 are offset to the outside in the width direction (see the guy links 50 indicated by a two-dot chain line in FIG. 14). More specifically, the portion of the guy link 50 located on the distal end side with respect to the second width direction bending portion 50*d* is displaced outward in the width direction with respect to the first link portion 50*a*. As a result of two respective guy links 50 being offset outward in the width direction, the distance in the width direction between the two guy links 50 is increased.

At this stage, the guy link 50 is moved outward in the width direction so that the guy link 50 can be inserted into the receiving jig 70 (see FIG. 7). Specifically, for example, the guy link 50 is moved outside in the width direction such that the eleventh link member 61 shown in FIG. 9 can be inserted into the first receiving jig 81, and the tenth link member 60 shown in FIG. 9 can be inserted into the second receiving jig 82. The operation of moving the guy link 50 in the width direction is manually performed by an operator, for example.

(Guy Link Storing Step)

Guy links 50 are stored at least after the first bending step, preferably after the second bending step. At this stage, at least a portion of the guy link 50 is disposed (stored) outside the front strut 32 in the width direction as shown in FIG. 8, and on the upper surface (back surface 21*a*) or the side surface of the lower jib 21 as shown in FIG. 7 (guy link 50 storing step). That is, after the first bending step, at least a portion of the guy link 50 located opposite to the first link portion 50*a* as viewed from the first width direction bending portion 50*b* is supported on at least one of the upper surface and the side surface of the lower jib 21 outside the front strut 32 in the width direction. The details of this step are as follows.

(Insertion of Guy Link into Fixing Jig and First Position Correcting Jig)

As shown in FIG. 14, when the guy link 50 is bent outward (for example, offset) in the width direction in the above bending step, the guy link 50 tends to move in a direction in which the bending in the width direction is eliminated (tends to return to the original position) by the own weight of the guy link 50. Therefore, the guy link 50 is inserted into the receiving jig 70 as shown in FIG. 9 so that the bending of the guy link 50 in the width direction does not return to the original posture. The details of this step are as follows.

As shown by a two-dot chain line in FIG. 14, the eleventh link member 61 shown in FIG. 9 is inserted into the first receiving jig 81 in a state where the guy link 50 is bent (for example, in an offset state). Further, the tenth link member 60 is inserted into the second receiving jig 82 in a state where the guy link 50 is bent. By inserting the guy link 50 into the first position correcting jig 73, the position of the guy link 50 in the width direction is guided and restricted. Specifically, the inclined portions 82*d*2 (see FIG. 11) of the second receiving jig 82 guide the position (movement) of the tenth link member 60 in the width direction. Therefore, the tenth link member 60 can be easily inserted into the second receiving jig 82. Further, the tenth link member 60 is stored in the storing portion 82*d*1 (see FIG. 11) of the second receiving jig 82 and hence, the position in the width direction of the tenth link member 60 is restricted (constrained). Next, the eleventh link member 61 is fixed to the first receiving jig 81. Further, the tenth link member 60 is fixed to the second receiving jig 82. In other words, in the guy link storing step, the guy link 50 is guided toward the storing portion 82*d*1 by the inclined portions 82*d*2 of the first position correcting jig 73, and then the guy link 50 is restrained in the width direction by the storing portion 82*d*1. As a result, the guy link 50 is supported on the upper surface of the lower jib 21.

Figure 3:
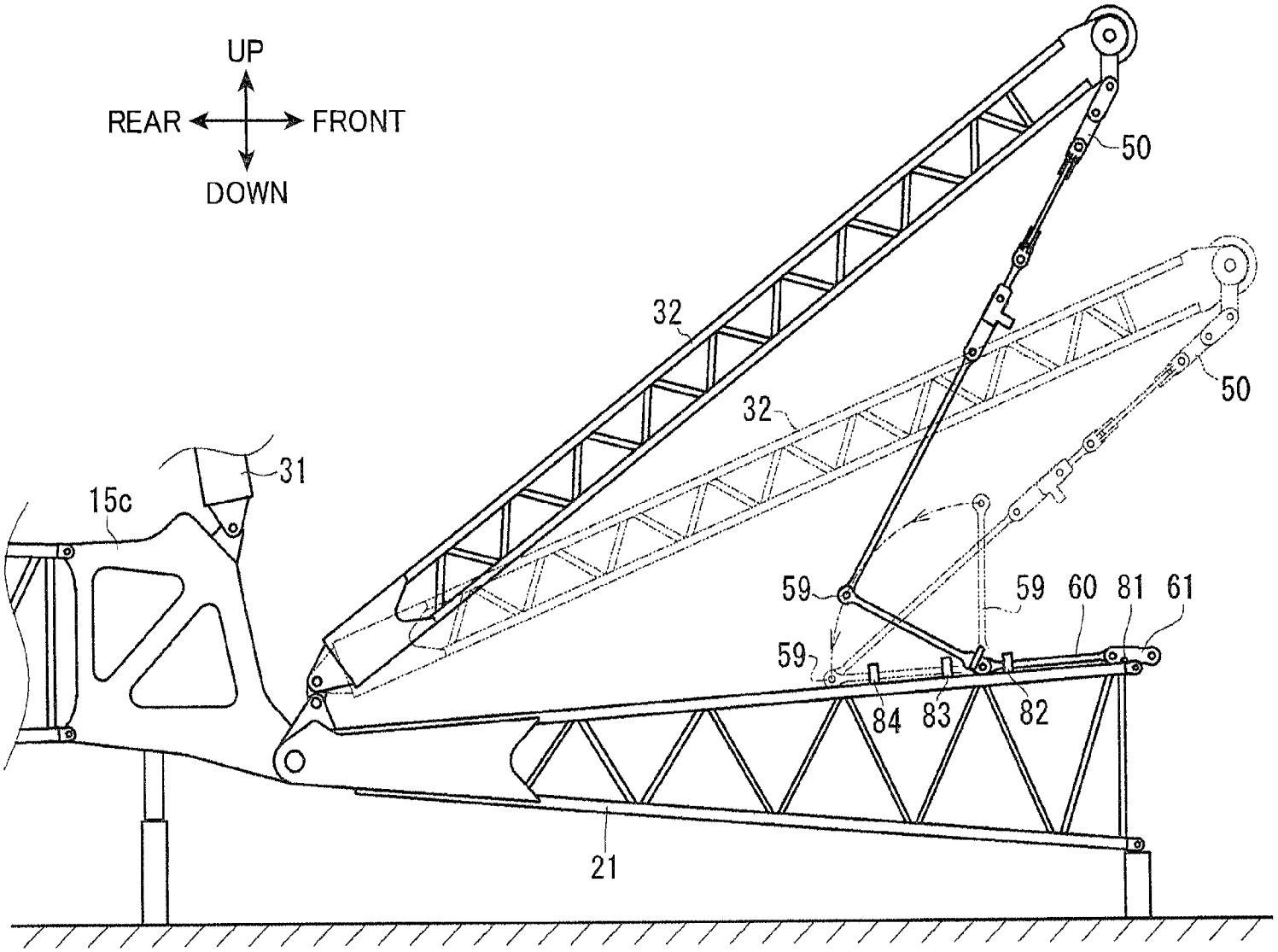
FIG. 3 is a side view showing a state where the second rising and falling member is lowered compared to the state shown in FIG. 2.

Next, as shown in FIG. 3, the front strut 32 is lowered. Then, the ninth link member 59 rotates with respect to the tenth link member 60 and falls back. The ninth link member 59 is formed such that the ninth link member 59 does not fall forward from a state in which the ninth link member 59 is erected in the vertical direction (a function of preventing the ninth link member 59 from falling). This falling prevention function is realized, for example, by bringing the connecting portion 85*c* of the fifth receiving jig 85 shown in FIG. 12 into contact with the tenth link member 60 shown in FIG. 3. Since the ninth link member 59 has a function that prevents the ninth link member 59 from falling frontward, the ninth link member 59 can easily fall automatically backward by lowering the front strut 32 as shown in FIG. 3. At this stage, the operator may manually push the ninth link member 59 backward (for example, by hand).

Next, the front strut 32 is further lowered. Then, the ninth link member 59 is inserted into the third receiving jig 83 and the fourth receiving jig 84. At this stage, the inclined portions of the third receiving jig 83 and the inclined portions of the fourth receiving jig 84 (see the inclined portion 82*d*2 shown in FIG. 11) guide the position (movement) of the ninth link member 59 in the width direction. Therefore, the ninth link member 59 is easily and automatically inserted into the third receiving jig 83 and the fourth receiving jig 84 simply by lowering the strut 30. At this stage, an operator may manually adjust the position of the guy link 50 in the width direction (the same is applied to succeeding steps). The ninth link member 59 may be fixed to the third receiving jig 83 or may not be fixed to the third receiving jig 83.

(Folding of Guy Link)

Figure 4:
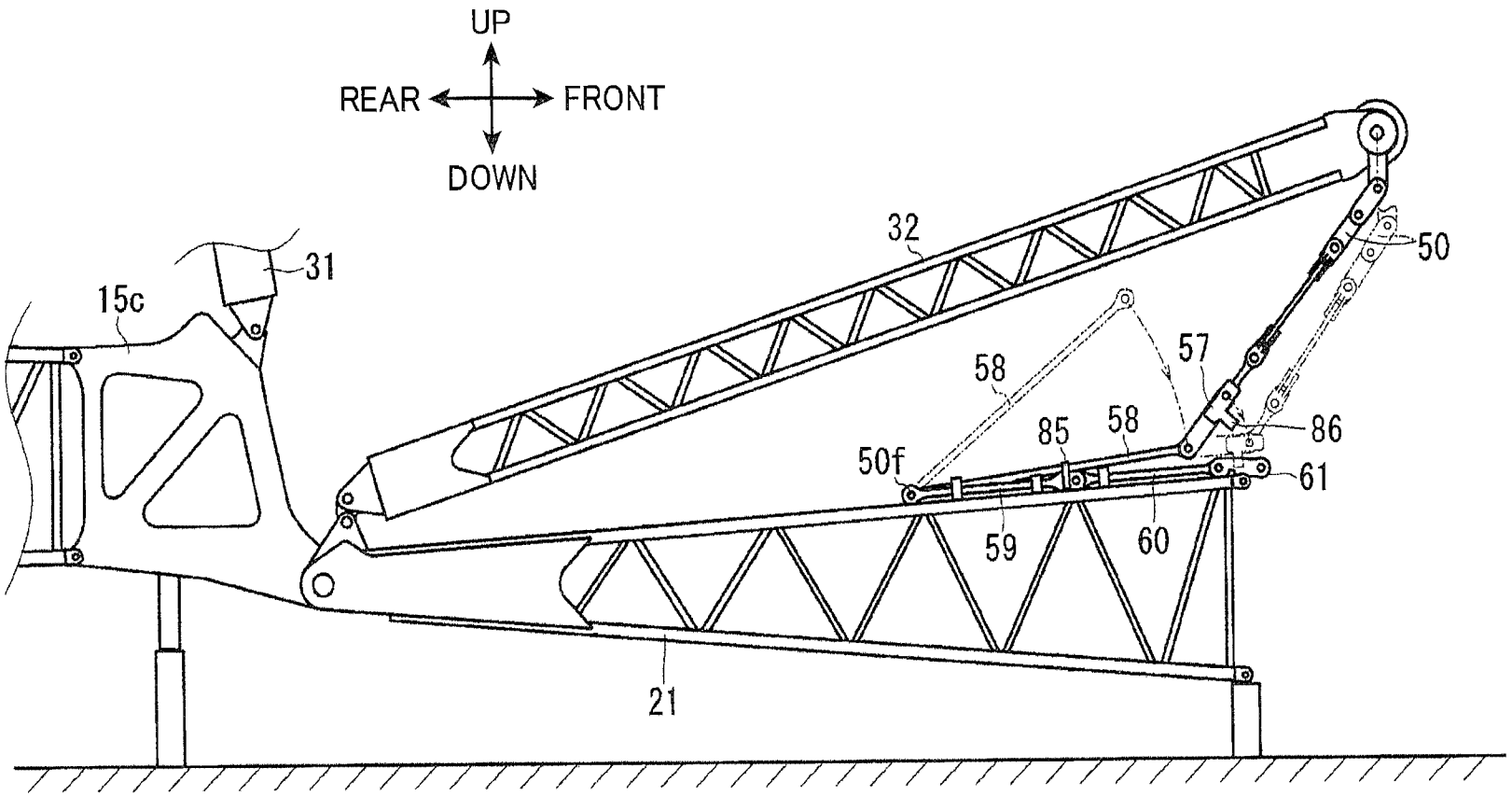
FIG. 4 is a side view showing a state where the second rising and falling member is lowered compared to the state shown in FIG. 3.

Next, as shown in FIG. 4, the front strut 32 is further lowered. Then, the eighth link member 58 rotates with respect to the ninth link member 59 and falls forward. As a result, the guy link 50 is folded about the center axis (folding portion 500 extending in the width direction. In particular, the portion of the guy link 50 located opposite to the first link portion 50*a* as viewed from the first width direction bending portion 50*b* is folded. At this stage, the eighth link member 58 (male link) enters between the ninth link members 59 (female links). Further, the eighth link member 58 rides on the ninth link members 59 and the tenth link member 60. Further, the seventh link member 57 rotates with respect to the eighth link member 58 and falls forward.

(Insertion of Guy Link to Second Position Correcting Jig)

When the guy link 50 is folded as described above, the guy link 50 is inserted into the second position correcting jig 74. Accordingly, the position in the width direction of the guy link 50 is guided and restricted. Specifically, the eighth link member 58 is inserted into the fifth receiving jig 85. Further, the eleventh link member 61 is inserted into the sixth receiving jig 86. At this stage, the inclined portion 85*d*2 of the fifth receiving jig 85 shown in FIG. 12 guides the position (movement) of the eighth link member 58 in the width direction. Also, as shown in FIG. 10, the inclined portions 86*d*2 of the sixth receiving jig 86 guide the position of the seventh link member 57 in the width direction. Therefore, as shown in FIG. 4, simply by lowering the strut 30, the eighth link member 58 can be automatically easily inserted into the fifth receiving jig 85, and the eleventh link member 61 is easily and automatically inserted into the sixth receiving jig 86. Further, the eighth link member 58 is stored in the storing portion 85*d*1 of the fifth receiving jig 85 shown in FIG. 12, so that the position in the width direction of the eighth link member 58 is restricted. Further, the eleventh link member 61 is stored in the storing portion 86*d*1 of the sixth receiving jig 86 shown in FIG. 10. Accordingly, the position in the width direction of the eleventh link member 61 is restricted. In other words, in the guy link storing step, the other portion of the guy link 50 is guided toward the storing portion 86*d*1 by the inclined portions 86*d*2 of the second position correcting jig 74, and then the other portion of the guy link 50 is restrained in the width direction by the storing portion 86*d*1. Accordingly, the guy link 50 is supported on the upper surface of the lower jib 21.

Figure 5:
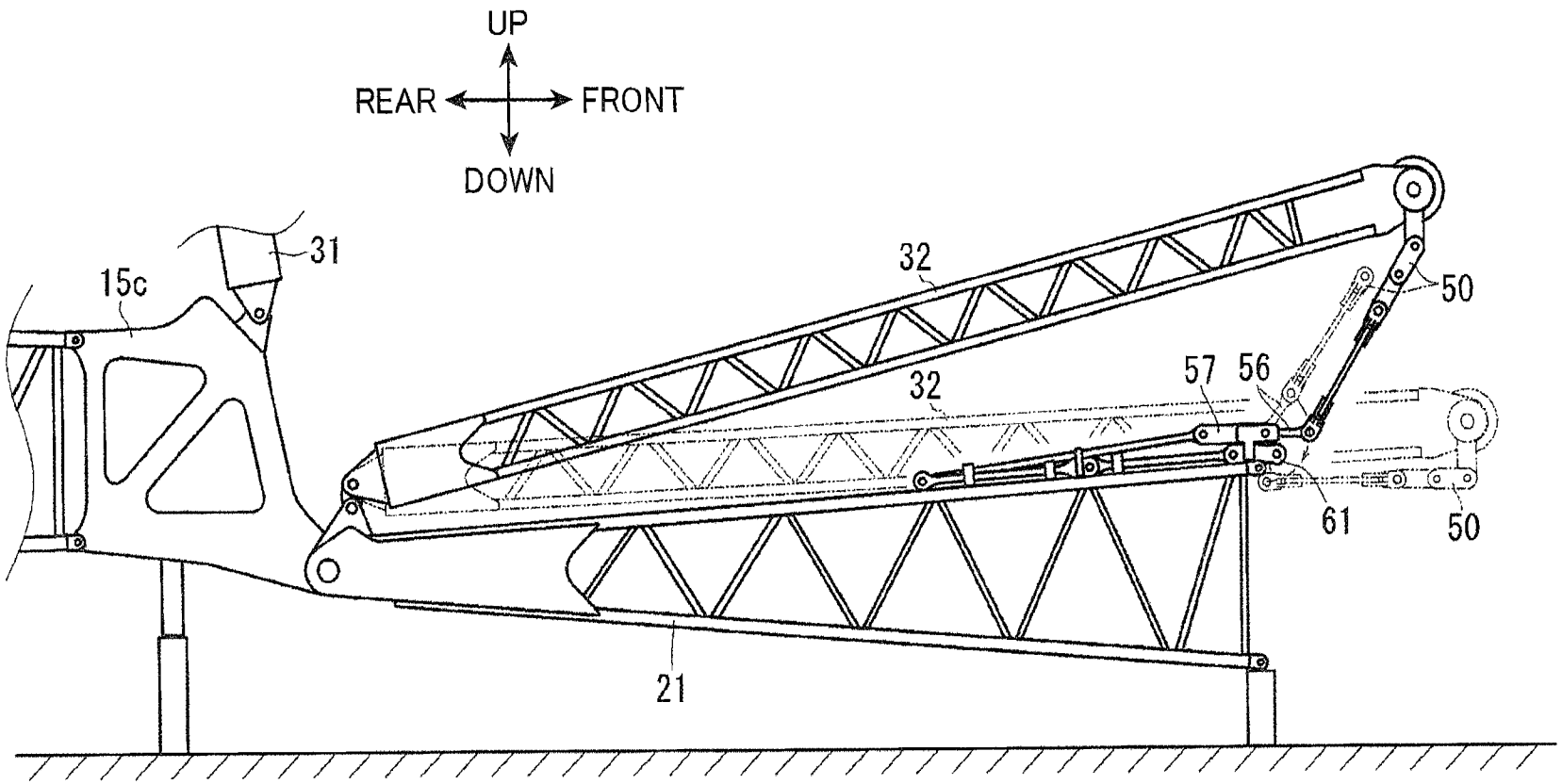
FIG. 5 is a side view showing a state where the second rising and falling member is lowered compared to the state shown in FIG. 4.

Next, as shown in FIG. 5, the front strut 32 is further lowered. Then, the sixth link member 56 rotates relative to the seventh link member 57 and falls. Then, the sixth link member 56 (male link) passes between the eleventh link members 61 (female links). Next, a pin is inserted into the front side portions of the eleventh link members 61 shown in FIG. 9. Accordingly, the movement (removal) of the sixth link member 56 toward the front side from the eleventh link members 61 is restricted. As a result, the portion of the guy link 50 shown in FIG. 7 located on a proximal end side (front side) with respect to the fifth link member 55 is restricted from moving upward. Therefore, the state where the front strut 32 and the guy link 50 are spaced apart from each other in the vertical direction can be maintained. Therefore, the contact (interference) between the front strut 32 and the guy link 50 can be suppressed. As shown in FIG. 8, even in the case where portions (the second link member 52 and the third link member 53) exist where the front strut 32 and the guy link 50 overlap with each other when viewed in the vertical direction, the contact between the front strut 32 and the guy link 50 can be suppressed.

Next, the front strut 32 is placed on the lower jib 21 as shown in FIG. 5 where the front strut 32 is indicated by a two-dot chain line. Next, as shown in FIG. 6, the front strut 32 and the guy link 50 are tightly fastened (lashed) by a tightly fastening member 90. Further, the lower jib 21 and the guy link 50 are tightly fastened by the tightly fastening member 90. As a result, the lower jib 21, the front strut 32, and the guy link 50 are brought into a stored state.

(Transportation)

Next, the lower jib 21 is removed from the upper boom 15*c*. Next, the lower jib 21, the front strut 32, and the guy link 50 are placed on a trailer T (transportation vehicle), for example. Then, the lower jib 21, the front strut 32, and the guy link 50 are transported integrally. The rear strut 31 may be transported integrally with these members. In this case, the rear strut 31 is placed on the front strut 32. Further, at least a portion of the strut guy link 43 may be transported integrally with the lower jib 21, the front strut 32, the guy link 50, and the front strut 32. In this case, at least a portion of the strut guy link 43 is placed on the front strut 32. The "at least a portion of the strut guy link 43" may include, for example, a width change link 43*a*. Further, "at least a portion of the strut guy link 43" may include a portion of or the whole boom side portion 43*b*. In this case, a maximum height h of a structure to be transported integrally with the trailer T and a maximum height of the trailer T is set to a height less than a transportation limit height (a limit value of a height during transportation on a public road or the like).

The advantageous effects acquired by the crane 1 (link storing device) shown in FIG. 2 are as follows.

In the present embodiment, the crane 1 includes the lower jib 21 (first rising and falling member), the front strut 32 (second rising and falling member), and the guy links 50. As shown in FIG. 7, the front strut 32 is transported integrally with the lower jib 21 in a state where the front strut 32 is placed on the lower jib 21. The guy links 50 are mounted on the distal end portion 32*t* of the front strut 32, and are rotatable with respect to the front strut 32 about a center axis extending in the width direction (the width direction of the rising and falling member). As shown in FIG. 8, the width (size in the width direction) of the portion of the front strut 32 located on the proximal end side with respect to the distal end portion 32*t* is larger than the width of the distal end portion 32*t* of the front strut 32. The guy link 50 includes the first link portion 50*a* and the first width direction bending portion 50*b*. The first link portion 50*a* is mounted on the distal end portion 32*t* of the front strut 32.

The first width direction bending portion 50*b* connects the portion of the guy link 50 that is located on the distal end side of the guy link 50 with respect to the first link portion 50*a* to the first link portion 50*a* such that the portion is bendable in the width direction.

When the guy link 50 is in a stored state, a portion of the guy link 50 that is located on the distal end side of the guy link 50 with respect to the first width direction bending portion 50*b* is disposed on the outer side in the width direction with respect to the first link portion 50*a*. When the guy link 50 is in a stored state, at least a portion of the guy link 50 is disposed outside the front strut 32 in the width direction and on the back surface 21*a* (upper surface) or side surface of the lower jib 21.

Further, in the present embodiment, the first width direction bending portion 50*b* connects the second link portion 50*c* and the first link portion 50*a* to each other such that the second link portion 50*c* is bendable in the width direction with respect to the first link portion 50*a*. Then, the first width direction bending portion 50*b* allows the guy link 50 to be bent at the first width direction bending portion 50*b* such that the second link portion 50*c* is disposed outside in the width direction than the first link portion 50*a* in the stored state, thus allowing at least a portion of the guy link 50 located opposite to the first link portion 50*a* as viewed from the first width direction bending portion 50*b* to be fixed to at least one of the upper surface and the left or right side surface of the lower jib 21 outside the front strut 32 in the width direction.

According to such a configuration, as shown in FIG. 8, although the width of the portion of the front strut 32 located on the proximal end side with respect to the distal end portion 32*t* is larger than the width of the distal end portion 32*t* of the front strut 32, it is possible to store the guy links 50 without causing interference between the guy links 50 and the front strut 32. As a result, it is not necessary to store the guy links 50 between the lower jib 21 and the front strut 32 shown in FIG. 7 in the vertical direction. Therefore, it is not necessary to provide a space in the vertical direction for storing the guy link 50 between the lower jib 21 and the front strut 32. Accordingly, the total height (the size in the vertical direction) of the lower jib 21 and the front strut 32 can be suppressed during transportation (in a stored state).

Further, when the lower jib 21 and the front strut 32 are transported integrally, it is not necessary to remove the guy links 50 from the front strut 32. Therefore, an operation to mount the guy links 50 removed from the front strut 32 on the front strut 32 also becomes unnecessary. As a result, it is possible to reduce the time and effort in the work for mounting or removing the guy links 50 on or from the front strut 32.

Since it is not necessary to remove the guy links 50 from the front strut 32, the following advantageous effects can be acquired. The guy links 50 need not be transported separately from the front strut 32 and the lower jib 21. Therefore, it is not necessary to use an object (such as a storing box) for storing the guy links 50.

In the present embodiment, the guy link 50 includes the second link portion 50*e* and the second width direction bending portion 50*d*. The second link portion 50*c* is connected to the first link portion 50*a* by way of the first width direction bending portion 50*b*. The second width direction bending portion 50*d* connects the portion of the guy link 50 located on the distal end side of the guy link 50 with respect to the second link portion 50*c* to the second link portion 50*c* such that the second width direction bending portion 50*d* is bent in the width direction.

In a stored state, the portion of the guy link 50 that is located on the distal end side of the guy link 50 with respect to the second width direction bending portion 50*d* is bendable toward the inside in the width direction at the second width direction bending portion 50*d* with respect to the longitudinal direction of the second link portion 50*c*.

In the present embodiment, the second width direction bending portion 50*d* connects the second link portion 50*c* and the third link portion 50*e* to each other such that the third link portion 50*e* is bendable in the width direction with respect to the second link portion 50*c*. In the stored state, the second width direction bending portion 50*d* allows the guy link 50 to be bent at the second width direction bending portion 50*d* so that the third link portion 50*e* is disposed on an inner side in the width direction with respect to a straight line connecting the first width direction bending portion 50*b* and the second width direction bending portion 50*d*, thus allowing the third link portion 50*e* to be fixed to at least one of the upper surface and the left or right side surface of the lower jib 21 on an outer side of the front strut 32 in the width direction.

According to such a configuration, the size of the guy link 50 in the width direction in a stored state can be suppressed compared to the case where the portion of the guy link 50 located on the distal end side with respect to the second width direction bending portion 50*d* extends in the longitudinal direction of the second link portion 50*c*.

In the present embodiment, as shown in FIG. 9, the crane 1 includes the first position correcting jig 73. The first position correcting jig 73 is mounted on the lower jib 21, and the guy link 50 can be inserted into the first position correcting jig 73. The first position correcting jig 73 guides and restricts the position in the width direction of the guy link 50 inserted into the first position correcting jig 73.

According to such a configuration, the guy link 50 can be easily disposed at the predetermined position (preliminary set position) in the width direction. The details of the advantageous effects acquired by the present embodiment are as follows. As shown in FIG. 14, the guy link 50 may be bent in the width direction at least at the first width direction bending portion 50*b* and may also be bent in the width direction at the second width direction bending portion 50*d*. As a result, the case may arise where, during the storing of the guy link 50, the bent portion of the guy link 50 tends to return to its original state (tends to be straight). In view of the above, as shown in FIG. 9, the first position correcting jig 73 guides and restricts the position of the guy link 50 in the width direction. Therefore, the guy link 50 can be easily disposed at a predetermined position in the width direction while maintaining the state where the guy link 50 is bent in the width direction.

In the present embodiment, the guy link 50 is stored in a state of being folded about the center axis (folding portion 50*f*) extending along the width direction in a stored state.

According to such a configuration, the size of the guy link 50 in the direction orthogonal to the width direction (for example, the front-rear direction) can be suppressed. As a result, the space for storing the guy links 50 can be reduced.

Further, in the present embodiment, the crane 1 includes the second position correcting jig 74 mounted on the guy link 50. The guy link 50 can be inserted into the second position correcting jig 74 in a state where the guy link 50 is folded. The second position correcting jig 74 guides and restricts the position in the width direction of the guy link 50 inserted into the second position correcting jig 74.

According to such a configuration, the folded guy link 50 can be easily disposed at a predetermined position in the width direction.

The advantageous effects acquired by the link storing method of the present embodiment are as follows. The link storing method is a method using the crane 1 (link storing device).

The crane 1 has the above configuration. The link storing method includes the guy link 50 suspending step, the first bending step, and the guy link 50 storing step. As shown in FIG. 2, the guy link 50 suspending step is the step in which the lower jib 21 is laid down, the front strut 32 is disposed above the lower jib 21, and the guy link 50 is suspended from the front strut 32. The first bending step is a step of, after the guy link 50 suspending step, disposing the portion of the guy link 50 shown in FIG. 8 located on the distal end side of the guy link 50 with respect to the first width direction bending portion 50*b* outside the first link portion 50*a* in the width direction. The guy link 50 storing step is a step of, after the first bending step, storing at least a portion of the guy link 50 outside the front strut 32 in the width direction and on the back surface 21*a* (upper surface) or the side surface of the lower jib 21.

According to such a method, in transporting the lower jib 21 and the front strut 32 integrally, it is not necessary to remove the guy links 50 from the front strut 32. Therefore, an operation to mount the guy links 50 removed form the front strut 32 on the front strut 32 also becomes unnecessary. As a result, it is possible to reduce the time and effort for an operation of mounting or removing the guy link 50 on or from the front strut 32. Further, since it is not necessary to remove the guy link 50 from the front strut 32, the following advantageous effects may be obtained. The guy links 50 need not be transported separately from the front strut 32 and the lower jib 21. Therefore, it is not necessary to use an object (such as a storing box) for storing the guy links 50.

Moreover, the crane storing method includes the second bending step. The second bending step is a step of, after the guy link 50 suspending step, bending the portion of the guy link 50 located on the distal end side of the guy link 50 with respect to the second width direction bending portion 50*d* inward in the width direction at the second width direction bending portion 50*d* with respect to the longitudinal direction of the second link portion 50*c*.

According to such a method, the size of the guy link 50 in the width direction in a stored state can be suppressed compared to the case where the portion of the guy link 50 located on the distal end side with respect to the second width direction bending portion 50*d* extends in the longitudinal direction of the second link portion 50*e*.

Furthermore, as shown in FIG. 9, the crane 1 includes the first position correcting jig 73 that is mounted on the lower jib 21 and into which the guy link 50 can be inserted. During the guy link 50 storing step, the position in the width direction of the guy link 50 inserted into the first position correcting jig 73 is guided and restricted.

According to such a method, the guy link 50 can be easily disposed at a predetermined position (preliminary set position) in the width direction. The details of the advantageous effects acquired by the present embodiment are as follows. As shown in FIG. 14, the guy link 50 may be bent in the width direction at least at the first width direction bending portion 50*b* and may also be bent in the width direction at the second width direction bending portion 50*d*. As a result, the case may arise where, during the storing of the guy link 50, the bent portion of the guy link 50 tends to return to its original state (tends to be straight). In view of the above, as shown in FIG. 9, the first position correcting jig 73 guides and restricts the position of the guy link 50 in the width direction. Therefore, the guy link 50 can be easily disposed at a predetermined position in the width direction while maintaining the state where the guy link 50 is bent in the width direction.

In the guy link 50 storing step, the guy link 50 is folded about the center axis (folding portion 50*f*) extending along the width direction.

According to such a method, the size of the guy link 50 in the direction orthogonal to the width direction (for example, the front-rear direction) can be suppressed. As a result, the space for storing the guy link 50 can be reduced.

Further, the crane 1 includes the second position correcting jig 74. The second position correcting jig 74 is mounted on the guy link 50, and the guy link 50 can be inserted when the guy link 50 is folded. During the guy link 50 storing step, the position in the width direction of the guy link 50 inserted into the second position correcting jig 74 is guided and restricted.

According to such a method, the folded guy link 50 can be easily disposed at the predetermined position in the width direction.

<Modification>

The above embodiment may be variously modified. For example, the arrangement and the shapes of the respective components may be changed. The number of components may be changed, and some of the components may not be provided. The fixing, the connection or the like between the components may be performed directly or indirectly.

For example, in the above embodiment, as shown in FIG. 7, the "first rising and falling member" is the lower jib 21, the "second rising and falling member" is the front strut 32, and the "guy link" is the guy link 50. On the other hand, for example, the "first rising and falling member" may be the lower boom 15*a* shown in FIG. 1, the "second rising and falling member" may be the mast 17 shown in FIG. 1, and the "guy link" may be at least a portion of the boom guy link 41 (for example, a mast side portion 41*a*).

Two struts 30 (rear struts 31 and front struts 32) are provided in the crane 1 in the above embodiment. However, only one strut 30 may be provided. The rear strut 31 may not be provided.

The number and types (the male links, the female links, the cross links and the like) of the link members forming the guy link 50 shown in FIG. 13 may be changed. The number and types (fixing jig 71, first position correcting jig 73, second position correcting jig 74) and the arrangement (such as the protruding directions) of the components (first receiving jig 81, second receiving jig 82 and the like) of the receiving jig 70 shown in FIG. 9 may be changed.

The second width direction bending portion 50*d* shown in FIG. 8 may not be provided. For example, in a stored state, the portion of the guy link 50 that is located on the distal end side with respect to the first width direction bending portion 50*b* may extend in a straight-line shape along the longitudinal direction of the second link portion 50*c*.

In the above embodiment, the mode is described where the guy link 50 is supported on the upper surface of the lower jib 21 in a stored state. However, the guy link 50 may be supported on the left or right side surface of the lower jib 21 as described above. In this case as well, it is desirable that a receiving jig (not shown) is disposed on the side surface of the lower jib 21. Further, the mode may be adopted in which the guy link 50 is supported on both the upper surface and the side surface of the lower jib 21. When the guy link 50 is supported on the upper surface of the lower jib 21, it is desirable that the width of the lower jib 21 in the lateral direction is larger than the width of the front strut 32 in the lateral direction.

The invention claimed is:

1. A rising and falling body of a work machine that is mounted on a machine body of a work machine and is capable of changing a state between a working state where the rising and falling body performs predetermined work and a stored state where the rising and falling body is removed from the machine body and is transportable, the rising and falling body comprising:

a first rising and falling member mounted on the work machine so as to be raised or lowered about a horizontal first rotation axis, the first rising and falling member having a predetermined width along a first width direction parallel to the first rotation axis in a state where the first rising and falling member is mounted on the work machine, the first rising and falling member extending along a first longitudinal direction orthogonal to the first width direction;

a second rising and falling member having a proximal end portion mounted on the work machine so as to be raised or lowered about a horizontal second rotation axis and a distal end portion opposite to the proximal end portion, the second rising and falling member having a predetermined width along a second width direction parallel to the second rotation axis in a state of being mounted on the work machine, the second rising and falling member extending along a second longitudinal direction orthogonal to the second width direction; and a guy link mounted on the distal end portion of the second rising and falling member so as to be swingable relative to the second rising and falling member, wherein in the working state, the first rising and falling member and the second rising and falling member are mounted on the work machine and the guy link is connected to the distal end portion of the second rising and falling member, and in the stored state, the first rising and falling member is laid down and the second rising and falling member is placed on the first rising and falling member so as to extend along the first rising and falling member, and the guy link is supported by the distal end portion of the second rising and falling member and at least a portion of the guy link is supported by the first rising and falling member, a width in the second width direction of a portion of the second rising and falling member that is closer to the proximal end portion than to the distal end portion is set to be larger than a width in the second width direction of the distal end portion of the second rising and falling member, and the guy link includes:

a first link portion mounted on the distal end portion of the second rising and falling member so as to be swingable about a center axis extending in parallel with the second width direction;

a second link portion disposed at a position farther from the center axis than the first link portion is; and a first bending portion that connects the first link portion and the second link portion so that the second link portion is bendable in the second width direction with respect to the first link portion, wherein the first bending portion allows the guy link to be bent at the first bending portion such that the second link portion is disposed outside in the second width direction than the first link portion in the stored state, thus allowing at least a portion of the guy link located opposite to the first link portion as viewed from the first bending portion to be fixed to at least one of an upper surface of the first rising and falling member and a side surface of the first rising and falling member outside the second rising and falling member in the second width direction.

2. The rising and falling body of a work machine according to claim 1, wherein the guy link further includes:

a third link portion disposed at a position farther from the center axis than the second link portion is; and a second bending portion that connects the second link portion and the third link portion so that the third link portion is bendable in the second width direction with respect to the second link portion, the second bending portion allowing, in the stored state, the guy link to be bent at the second bending portion so that the third link portion is disposed on an inner side in the second width direction with respect to a straight line connecting the first bending portion and the second bending portion, thus allowing the third link portion to be fixed to at least one of the upper surface and the side surface of the first rising and falling member on an outer side of the second rising and falling member in the second width direction.

3. The rising and falling body of a work machine according to claim 1, further comprising a first reception jig mounted on the first rising and falling member and being capable of receiving the guy link in the stored state, wherein the first reception jig includes a first restraining portion that restrains the guy link in the second width direction, and a first guide portion that guides the guy link toward the first restraining portion.

4. The rising and falling body of a work machine according to claim 1, wherein the guy link further includes a storing and bending portion that is bendable about a center axis extending in the second width direction, the storing and bending portion allowing the guy link to be supported on the first rising and falling member in a state where the guy link is folded at the storing and bending portion in the stored state.

5. The rising and falling body of a work machine according to claim 4, further comprising a second reception jig mounted on one portion of the guy link and being capable of receiving the other portion of the guy link when the guy link is folded in the stored state, wherein the second reception jig includes: a second restraining portion that restrains the other portion of the guy link in the second width direction; and a second guide portion that guides the other portion of the guy link toward the second restraining portion.

6. A method for storing a rising and falling body of a work machine, the rising and falling body including:

a first rising and falling member mounted on the work machine so as to be raised or lowered about a horizontal rotation axis;

a second rising and falling member having a proximal end portion mounted on the work machine so as to be raised or lowered about a horizontal rotation axis and a distal end portion opposite to the proximal end portion; and a guy link mounted on the distal end portion of the second rising and falling member so as to be swingable relative to the second rising and falling member, the method comprising:

a preparation step of preparing, as the guy link, a structure including: a first link portion mounted on the distal end portion of the second rising and falling member so as to be swingable about a center axis extending in a width direction parallel to the rotation axis of the second rising and falling member; a second link portion disposed at a position farther from the center axis than the first link portion is; and a first bending portion that connects the first link portion and the second link portion so that the second link portion is bendable in the width direction with respect to the first link portion;

a guy link suspending step of bringing about a state where the first rising and falling member is laid down, the second rising and falling member is disposed above the first rising and falling member such that the distal end portion of the second rising and falling member is disposed at a position higher than the proximal end portion of the second rising and falling member, and the guy link is suspended from the distal end portion of the second rising and falling member;

a first bending step of, after the guy link suspending step, lowering the distal end portion of the second rising and falling member, and bending the guy link at the first bending portion such that the second link portion of the guy link is disposed on an outer side in the width direction with respect to the first link portion; and a guy link storing step of, after the first bending step, supporting at least a portion of the guy link located opposite to the first link portion as viewed from the first bending portion on at least one of an upper surface and a side surface of the first rising and falling member on an outer side in the width direction of the second rising and falling member.

7. The method for storing a rising and falling body of a work machine according to claim 6, wherein the preparation step includes preparing, as the guy link, a structure further including: a third link portion disposed at a position farther from the center axis than the second link portion is; and a second bending portion connecting the second link portion and the third link portion so that the third link portion is bendable in the width direction with respect to the second link portion, and the method further comprises a second bending step of, after the guy link suspending step, bending the guy link at the second bending portion such that the third link portion of the guy link is disposed on an inner side in the width direction with respect to a straight line connecting the first bending portion and the second bending portion.

8. The method for storing a rising and falling body of a work machine according to claim 6, wherein the preparation step includes further preparing a first reception jig mounted on the first rising and falling member and capable of receiving the guy link, the first reception jig including: a first restraining portion for restraining the guy link in the width direction; and a first guide portion that guides toward the first restraining portion, and the guy link storing step includes supporting the guy link on at least one of the upper surface and the side surface of the first rising and falling member by guiding the guy link toward the first restraining portion by the first guide portion of the first reception jig and then restraining the guy link by the first restraining portion in the width direction.

9. The method for storing a rising and falling body of a work machine according to claim 6, wherein the guy link storing step includes supporting the guy link on at least one of the upper surface and the side surface of the first rising and falling member while folding a portion of the guy link located opposite to the first link portion as viewed from the first bending portion about a center axis extending in the width direction.

10. The method for storing a rising and falling body of a work machine according to claim 9, wherein the preparation step includes further preparing a second reception jig mounted on one portion of the guy link and capable of receiving the other portion of the guy link when the guy link is in a folded state, the second reception jig including: a second restraining portion for restraining the other portion of the guy link in the width direction; and a second guide portion for guiding the other portion of the guy link toward the second restraining portion, and the guy link storing step includes supporting the guy link on at least one of the upper surface and the side surface of the first rising and falling member by guiding the other portion of the guy link toward the second restraining portion by the second guide portion of the second reception jig and then restraining the other portion of the guy link by the second restraining portion in the width direction.

* * * * *